US006448877B1

(12) United States Patent
Harayama et al.

(10) Patent No.: US 6,448,877 B1
(45) Date of Patent: Sep. 10, 2002

(54) ELECTROMAGNETIC RELAY HAVING A REDUCED HEIGHT

(75) Inventors: Hideto Harayama; Shigemitsu Aoki; Yoshio Okamoto, all of Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 0 days.

(21) Appl. No.: 09/998,162

(22) Filed: Dec. 3, 2001

(30) Foreign Application Priority Data

Apr. 27, 2001 (JP) ..... 2001-133057

(51) Int. Cl.[7] ..... H01H 51/28
(52) U.S. Cl. ..... 335/78; 335/83
(58) Field of Search ..... 335/78–86, 202

(56) References Cited

U.S. PATENT DOCUMENTS 5,027,094 A * 6/1991 Yasuoka et al. ..... 335/202

* cited by examiner

*Primary Examiner*—Ramon M. Barrera
(74) *Attorney, Agent, or Firm*—Staas & Halsey LLP

(57) ABSTRACT

An electromagnetic relay has a reduced height while maintaining a good voltage withstand. A base unit includes a metal plate member and a base mold made of a plastic, the metal plate member having a break fixed contact point and a break terminal and being insertion-molded with the base mold. A subassembly, including an electromagnet assembly and a movable leaf spring/armature assembly attached to the electromagnet assembly, is fixed to an upper side of the base unit. The electromagnet assembly includes a bobbin, a coil, an iron core and a yoke. The movable leaf spring/armature assembly includes a movable leaf spring having a movable contact point and an armature fixed to the movable leaf spring. A make terminal member having a make fixed contact point and a make terminal is fixed to the base unit. The base mold has a yoke attaching part to which the yoke of the electromagnet assembly is attached and a make terminal member attaching part to which the make terminal member is attached. The subassembly is mounted to the base unit by the yoke of the electromagnet assembly being attached to the yoke attaching part of the base mold. The make terminal member is mounted to the base unit by being attached to the make terminal attaching part of the base mold.

8 Claims, 18 Drawing Sheets

$t30 < t31$

ELECTROMAGNETIC RELAY HAVING A REDUCED HEIGHT

BACKGROUND OF THE INVENTION

1. Field of the Invention

The present invention generally relates to electromagnetic relays and, more particularly, to an electromagnetic relay suitable for an electric component incorporated into electric equipment for automobile.

Electromagnetic relays are incorporated into various equipments. Since a space into which an electromagnetic relay is accommodated has been reduced in connection with miniaturization of electric equipment, there is a demand for reducing heights of electromagnetic relays.

A maximum electric current of an electromagnetic relay used in electric equipment for automobile is required to be as high as 30 amperes. Such a high maximum electric current causes a large amount of heat generated in the electromagnetic relay, and it is necessary to achieve an efficient radiation of heat from the electromagnetic relay.

2. Description of the Related Art

FIG. 1 is a perspective view of a conventional electromagnetic relay 10 of electric equipment for automobile in a state where a cover is removed. FIG. 2 is a side view of the electromagnetic relay 10 shown in FIG. 1. In FIG. 1, directions X1 and X2 correspond to a direction of width of the electromagnetic relay 10; directions Y1 and Y2 correspond to a longitudinal direction; and directions Z1 and Z2 correspond to a direction of height.

The electromagnetic relay 10 comprises, as shown in FIG. 3, a subassembly 11, a base unit 30 and a terminal member 40 having a make fixed contact. The subassembly 11 is attached on the base unit 30, and the terminal member 40 is inserted from the X2 side.

The subassembly 11 comprises, as shown in FIG. 4, a plastic bobbin 12 on which a coil 13 is wound. An iron core 14, a yoke 16, a movable leaf spring/armature assembly 17 are incorporated into the bobbin 12. The coil 13, the iron core 14 and the yoke 16 together constitute an electromagnet.

The bobbin 12 has a square frame part 12*a* on the Y2 side and a square frame part 12*b* on the Y1 side. A hook part 12*c* is formed on a bottom part of the square frame part 12*a*. A cylindrical projection 12*d* is formed on a bottom part of the square frame part 12*b*. A coil terminals 25 and 26 are insert-molded with the square frame part 12*b*.

The iron core 14 having an iron base plate 15 is incorporated into the bobbin 12 from the Y1 side. The L-shaped yoke 16 is incorporated into the bobbin 12 from the Y2 side, and an end of the iron core 14 is secured to the yoke by caulking. Additionally, the movable leaf spring/armature assembly 17 is attached to the bobbin 12 on the Y1 side.

The movable leaf spring/armature assembly 17 comprises a generally L-shaped movable leaf spring 20, a square armature 21 and a movable contact member 22. The movable leaf spring 20 comprises a main part 20*a*, a spring arm part 30*b* extending from the main part 20*a* in the Y2 direction and a common terminal 20*c* extending from the main part 20*a* in the Z2 direction. The armature 21 is fixed to a root of the spring arm part 20*b*. The movable contact member 22 is fixed on an end of the spring arm part 20*b*. The main part 20*a* is fixed to iron base plate 15 by caulking.

The base unit 30 has a structure in which a break fixed contact member 32 is insert-molded with a plastic base 31. A break terminal part 32*a* extends from the base 31 in the Z2 direction. A break fixed contact 33 is exposed on the break fixed contact member 32. The base 31 is provided with apertures 34 and 35 for attaching the subassembly 11. The base 31 is also provided with an aperture 36 and a notch 37 for attaching the terminal member 40 having the make fixed contact.

The terminal 40 wit the make fixed terminal has a generally L-shape, and comprises a make terminal part 40*a*, a concave part 40*b* and a make fixed contact member 41.

The subassembly 11 is attached to the base unit 30 by the cylindrical projection 12*d* being fit in the aperture 35 and the hook part 12*c* being fit in the aperture 34. The terminal 40 is attached to the attached to the base unit 30, after the subassembly 11 and base unit 30 are assembled together, by being inserted from the X2 side in a state in which the concave part 40*b* is fit in the aperture 36 and a root of the make terminal 40*a* is fit in the notch 37.

The yoke 16 is located under the coil 13, and the armature 21 is located under the yoke 16. Additionally, the movable contact member 22 contacts the break fixed contact member 32. The make fixed contact member 41 is located above the movable contact member 22. In the normal state, the common terminal part 20*c* and the break terminal part 32*a* are in a "closed" state, and the common terminal part 20*c* and the make terminal part 40*a* are in an "open" state.

The electromagnetic relay 10 has a height h1 as shown in FIG. 1, and is mounted to a printed board in a state in which the terminals and terminal parts are inserted into through holes formed in the printed board.

When a current is supplied to the coil 13, the electromagnet is exited, and the armature 21 is magnetically attracted by the yoke 16. Accordingly, the spring arm part 20*b* is formed upward, which causes the movable contact member 22 being brought into contact with the make fixed contact member 41. Thereby, the state of the common terminal part 20*c* and the break terminal part 32*a* is changed to an "open" state, and the state of the common terminal part 20*c* and the make terminal part 40*a* is changed to a "closed" state.

The conventional electromagnetic relay 10 shown in FIG. 1 has a problem in that it is difficult to reduce the height for the following reasons.

(1) The base unit 30 has a relatively large thickness t1 as shown in FIG. 1 so as to maintain a strength of engagement of the hook part 12*c*, which fixes the subassembly 11 to the base unit 30.

(2) The terminal member 40 is attached to the base 31 by the concave part 40*b* is fit in the aperture 36 and the root of the make terminal part 40*a* is fit in the notch 37. This structure for attaching the terminal member 40 cannot provide a high positioning accuracy of the terminal member 40. Additionally, since the member to which the terminal member 40 is attached is different from the member to which the yoke 16 is attached, a distance a between the make fixed contact member 41 and the yoke 16 tends to fluctuate when the electromagnetic relay 10 is assembled. Thus, the distance a between the make fixed contact member 41 and the yoke 16 is set larger than an actually necessary distance so as to maintain a sufficient withstand voltage, thereby increasing the height of the electromagnetic relay 10.

(3) Since the accuracy of attaching the terminal member 40 is not so high, a distance b between the make fixed contact member 41 and the break fixed contact member 32 is set larger than an actually required distance as shown in FIG. 2 so as to maintain a sufficient withstand voltage. This prevents a reduction in the height of the electromagnetic relay 10.

In the conventional electromagnetic relay 10 shown in FIG. 1, the coil 13 is excited so as to close the contact between the common terminal part 20*c* and the make terminal part 40*a*. When an electric current of 30 amperes flows through the contact, a large amount of heat is generated. The generated heat is transferred to and spread into the printed bard through the common terminal part 20*c* and the make terminal part 40*a,* and the heat is dispersed into the printed board, and is radiated to the atmosphere. However, a heat transmission path of the heat generated in the electromagnetic relay is small, and the resistance of the heat transmission path is high. Thus, the conventional electromagnetic relay 10 has a low heat radiation.

Additionally, in the electromagnetic relay 10, each of the terminal parts 20*c,* 32*a* and 40*a* and the terminals 25 and 26 has a small width and directions of extension are not the same. Accordingly, it is impossible to spot-weld the terminal parts 20*c,* 32*a* and 40*a* and terminals 25 and 26 to other terminals. Thus, it is difficult to use a spot-welding to mount the electromagnetic relay 10 to a relay box of an automobile.

SUMMARY OF THE INVENTION

It is a general object of the present invention to provide an electromagnetic relay in which the above-mentioned problems are eliminated.

A more specific object of the present invention is to provide an electromagnetic relay having a reduced height while maintaining a good voltage withstand.

In order to achieve the above-mentioned objects, there is provided according to the present invention an electromagnetic relay comprising: a base unit including a metal plate member and a base mold made of a plastic, the metal plate member having a break fixed contact point and a break terminal and being insertion-molded with the base mold; a subassembly fixed to an upper side of the base unit and including an electromagnet assembly and a movable leaf spring/armature assembly attached to the electromagnetic assembly, the electromagnet assembly including a bobbin, a coil, an iron core and a yoke, the movable leaf spring/armature assembly including a movable leaf spring having a movable contact point and an armature fixed to the movable leaf spring; and a make terminal member fixed to the base unit and having a make fixed contact point and a make terminal, wherein the base mold of the base unit has a yoke attaching part to which the yoke of the electromagnetic assembly is attached and a make terminal member attaching part to which the make terminal member is attached, and the sub assembly is mounted to the base unit by the yoke of the electromagnet assembly being attached to the yoke attaching part of the base mold, and the make terminal member is mounted to the base unit by being attached to the make terminal attaching part of the base mold.

According to the present invention, the subassembly is mounted to the base unit by attaching the yoke of the electromagnet assembly to the base mold of the base unit. Accordingly, it becomes possible to adopt a slide fit mechanism to mount the subassembly to the base unit. The slide fit mechanism for mounting the subassembly does not increase a height of the electromagnetic relay.

Additionally, since the make terminal member is fittingly attached to the make terminal member attaching part, the position of the make terminal member can be attached to the base unit with high accuracy. Therefore, it becomes unnecessary to consider the variation in the position of the make terminal member, and the height of the electromagnetic relay is reduced accordingly.

Moreover, a part of space between the yoke and the make terminal member and a part of a space between the metal plate member and the make terminal member are occupied by a part of the base mold, which gives a better insulation than a case in which the above-mentioned spaces are empty. Further, the number of factors of the variation in assembly decreases, and it becomes possible to reduce a distance between adjacent parts, which gives a low-height electromagnetic relay.

In the electromagnetic relay according to the present invention, the metal plate member may have a base plate part having the same horizontal projection size as that of the electromagnetic relay; the base mold may extend along a periphery of the base plate part and has long side base mold parts opposite to each other; each of the yoke attaching part and the make terminal member attaching part may be formed on each of the long side base mold parts; and both sides of each of the yoke and the make terminal member may be secured to the respective long side base mold parts.

According to the above-mentioned invention, the base mold is mechanically strengthened by the base plate part. Additionally, both sides of the yoke and the make terminal member are attached to the long side base mold parts. Accordingly, the yoke and the make terminal member can be attached to the base unit with high accuracy, and the mechanical strength of the attaching part is high.

Additionally, the metal plate member may have a base plate part having the same horizontal projection size as that of the electromagnetic relay; and the base mold may extend along a periphery of the base plate part and has an armature offset preventing projection, which faces a lower surface of the armature.

Accordingly, when the armature tends to greatly deform downward due to a shock applied to the electromagnetic relay, the armature offset preventing projection contacts the armature, which prevents a permanent deformation of a the movable leaf spring part to which the armature is fixed.

Additionally, in the electromagnetic relay according to the present invention, a number of each of common terminals, the brake terminals and the make terminals, which are electrically connected to the movable leaf spring, may be plural.

Preferably, the brake terminals and the make terminals, which are electrically connected to the movable leaf spring, is two; and one of the two terminals is located on one side of the electromagnetic relay and the other is located on the other side of the electromagnetic relay.

Additionally, in the electromagnetic relay according to the present invention, an end of each of the terminals may be bent outward.

Accordingly, the electromagnetic relay can be mounted to a printed circuit board by an SMT mounting method. Since a plurality of terminals are collectively provided in a small area, a thermal stress due to a difference in the thermal expansion coefficient between the electromagnetic relay and the printed circuit board can be reduced. Thus, a number of heat cycles until a soldered portion of the terminal breaks is increased, which improves the reliability of the electromagnetic relay with respect to a thermal stress.

Additionally, in the electromagnetic relay according to the present invention, each of the terminals may include a leg part and a foot part, the foot part being formed by bending each terminal to as to extend horizontally; and a width of the foot part is larger than a width of the leg part.

Since a soldering area of each terminal is increased due an increase in the width of the foot part, the terminal can be soldered to a pad of the printed circuit board with a good bonding force, and a good resistance of thermal stress can be achieved.

Further, in the electromagnetic relay according to the present invention, each of the terminals may include a leg part and a foot part, the foot part being formed by bending each terminal to as to extend horizontally; and a thickness of the leg part may be smaller than a thickness of the foot part.

Since the leg part is easily bent, a thermal stress can be relaxed, which improves the reliability with respect to a thermal stress.

Other objects, features and advantages of the present invention will become more apparent from the following detailed description when read in conjunction with the accompanying drawings.

DETAILED DESCRIPTION OF THE PREFERRED EMBODIMENTS

A description will now be given of an electromagnetic relay 50 according to a first embodiment of the present invention.

Figure 5:
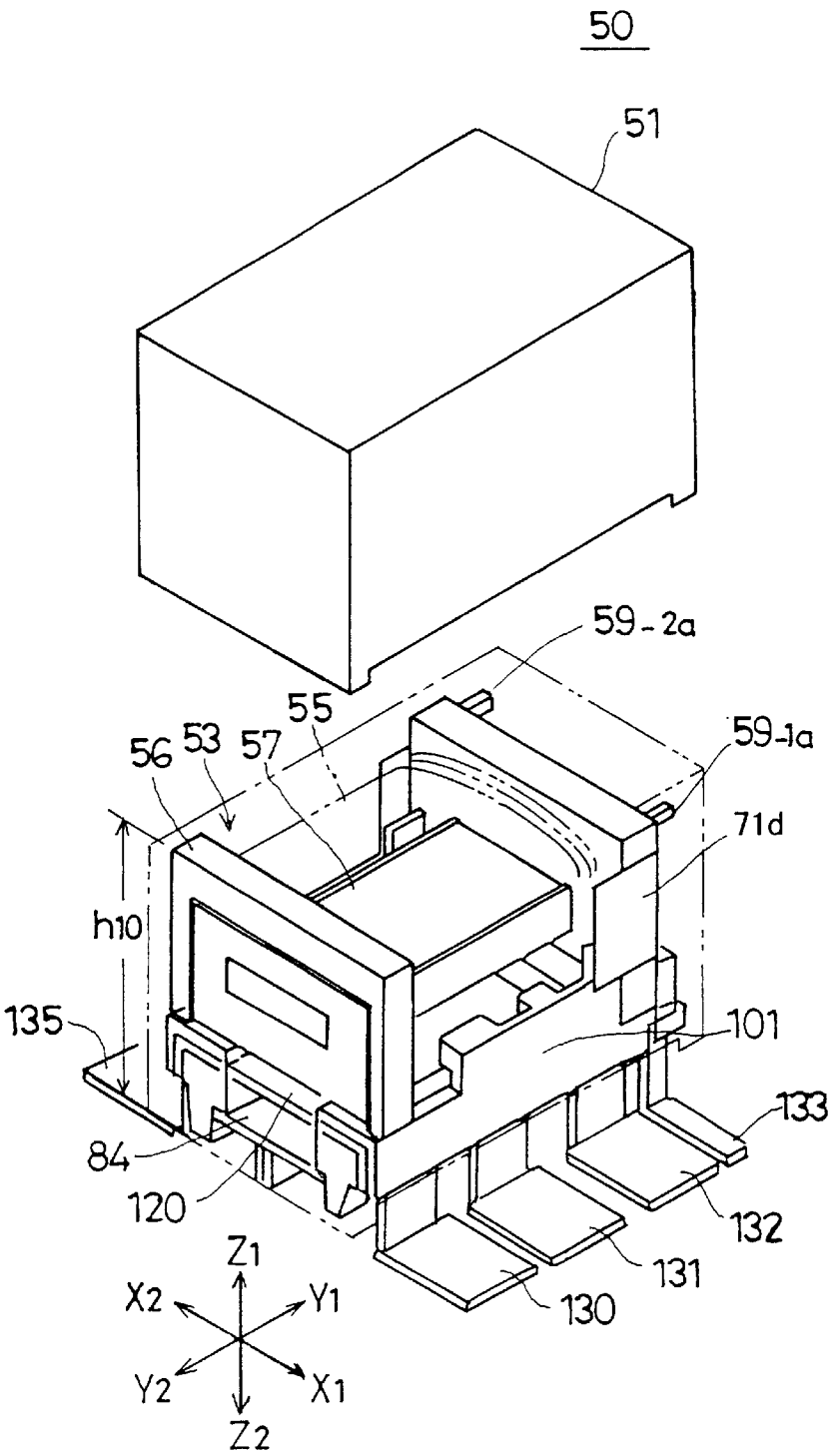
FIG. 5 is a perspective view of the electromagnetic relay from which a cover is removed.
Figure 6A:
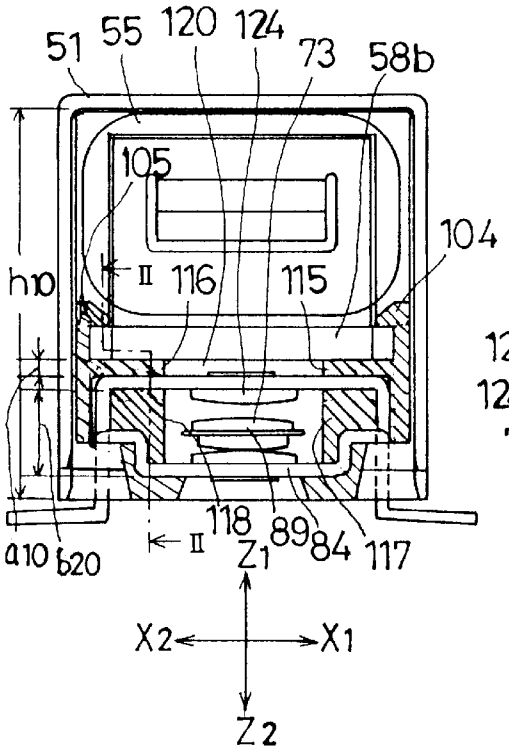
FIG. 6A is a side view of an interior of the electromagnetic relay viewed from Y2 side.
Figure 6B:
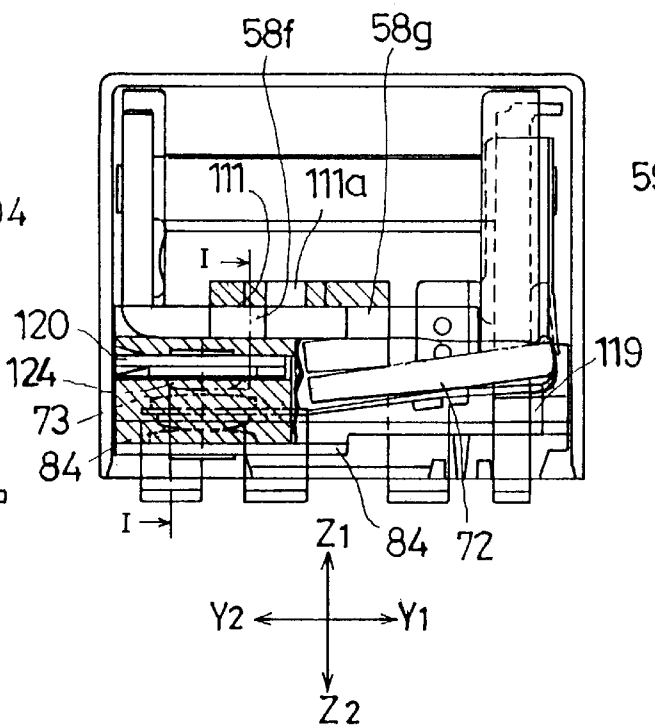
FIG. 6B is a side view of the interior of the electromagnetic relay viewed from X1 side.
Figure 6C:
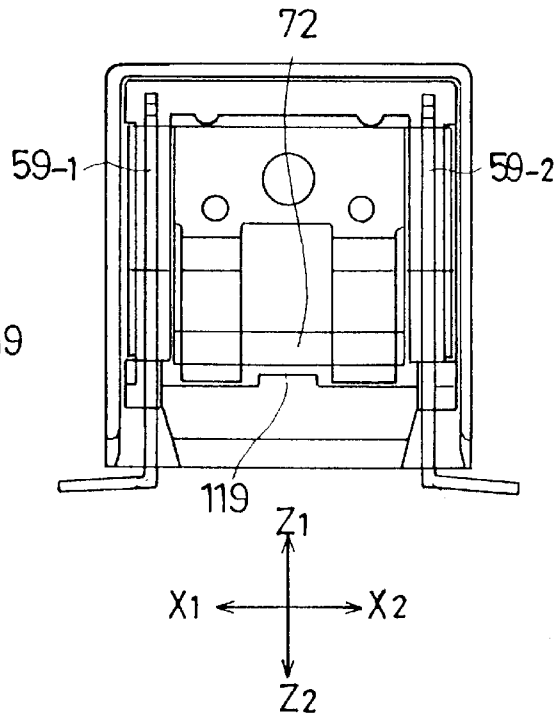
FIG. 6C is a side view of the interior of the electromagnetic relay viewed from Y1 side.
Figure 7A:
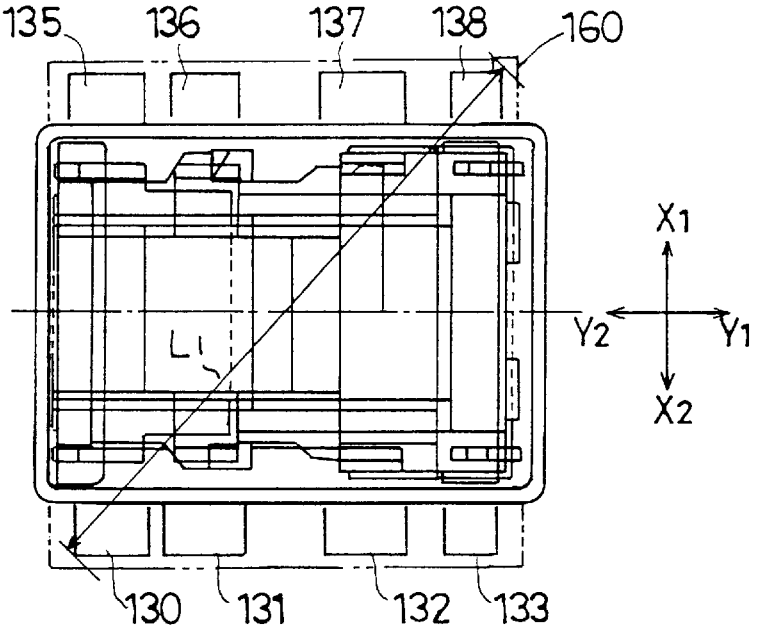
FIG. 7A is a bottom view of the interior of the electromagnetic relay viewed from Z1 side.
Figure 7B:
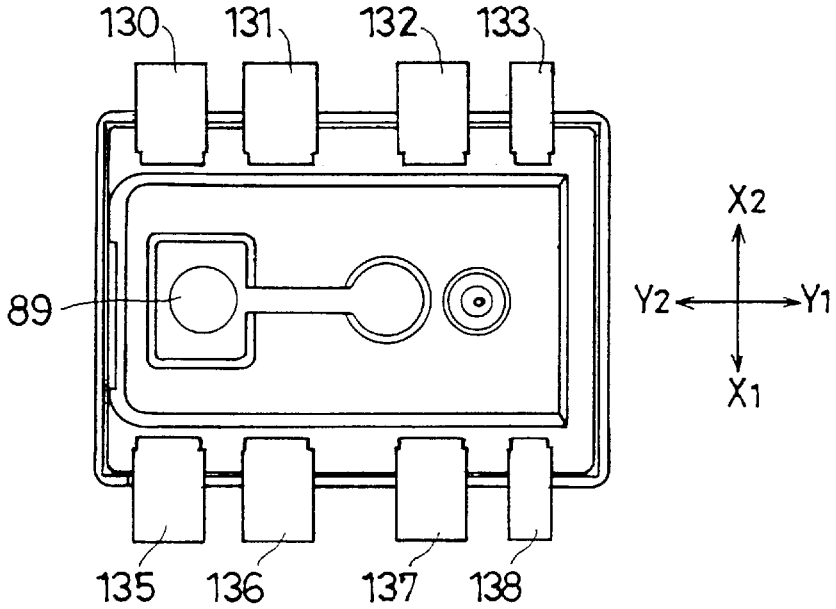
FIG. 7B is a top plan view of the electromagnetic relay viewed from Z2 side.
Figure 7C:
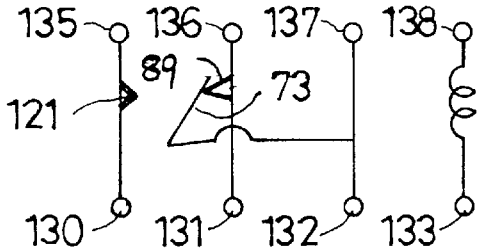
FIG. 7C is a circuit diagram of the electromagnetic relay.

FIG. 5 is a perspective view of the electromagnetic relay 50 for automobile equipment in a state in which a cover 51 is removed. FIG. 6A is a side view of an interior of the electromagnetic relay 50 viewed from Y2 side. FIG. 6B is a side view of the interior of the electromagnetic relay 50 viewed from X1 side. FIG. 6C is a side view of the interior of the electromagnetic relay 50 viewed from Y1 side. It should be noted that, a cross-sectional part shown in FIG. 6A is taken along a line I—I in FIG. 6B, and a cross-sectional part shown in FIG. 6B is taken along a line II—II in FIG. 6A. FIG. 7A is a bottom view of the interior of the electromagnetic relay 50 viewed from Z1 side. FIG. 7B is a top plan view of the electromagnetic relay 50 viewed from Z2 side. In each of the above-mentioned figures, directions X1 and X2 correspond to a direction of width of the electromagnetic relay 50; directions Y1 and Y2 correspond to a longitudinal direction; and directions Z1 and Z2 correspond to a direction of height.

Figure 8:
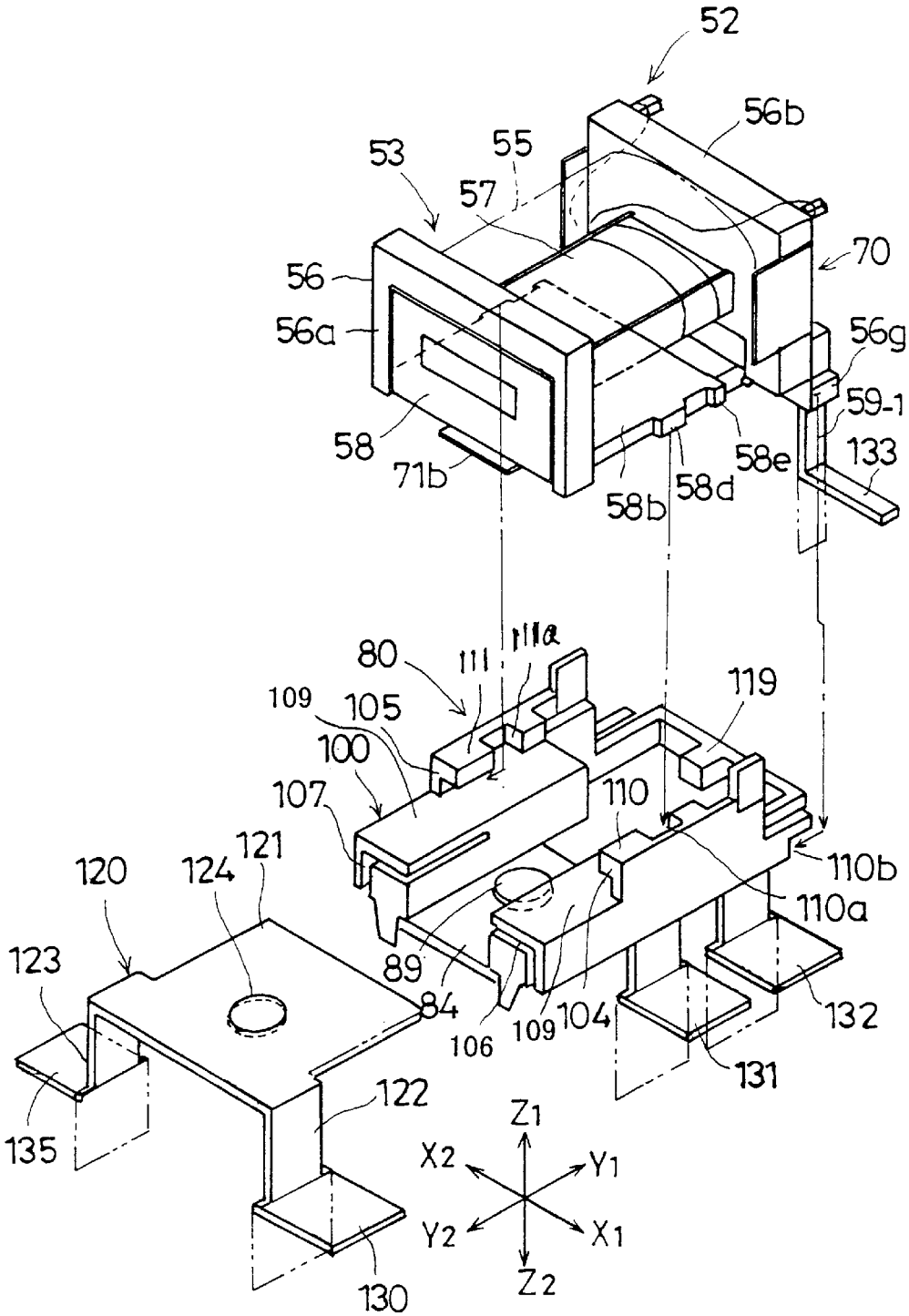
FIG. 8 is an exploded perspective view of the interior of the electromagnetic relay shown in FIG. 5.

FIG. 8 is an exploded perspective view of the interior of the electromagnetic relay 50. The electromagnetic relay 50 comprises, as shown in FIG. 8, a subassembly 52, a base unit 80 and a terminal member 120 with a make fixed contact point. In the electromagnetic relay 50, the base unit 80 serves as a reference part.

The subassembly 52 is attached to the base unit 80 on Z1 side, and the terminal member 120 with the make fixed contact point is attached to the base unit 80 on Y2 side. A make terminal tip part 130 as a foot part, a break terminal tip part 131, a common terminal tip part 132 and a coil terminal tip part 133 are arranged on X1 side of the electromagnetic relay 50 from Y2 side in the direction Y1. Similarly, a makeup terminal tip part 135 as a foot part, a break terminal tip part 136, a common terminal tip part 137 and a coil terminal tip part 138 are arranged on X2 side from Y2 side in the direction Y1.

Each of the make terminal tip parts 130 and 135, the break terminal tip parts 131 and 136, the common terminal tip parts 132 and 137 and the coil terminal tip parts 133 and 138 is bent outward so as to extend horizontally. Therefore, the electromagnetic relay 50 is surface-mountable to a printed circuit board.

Figure 9:
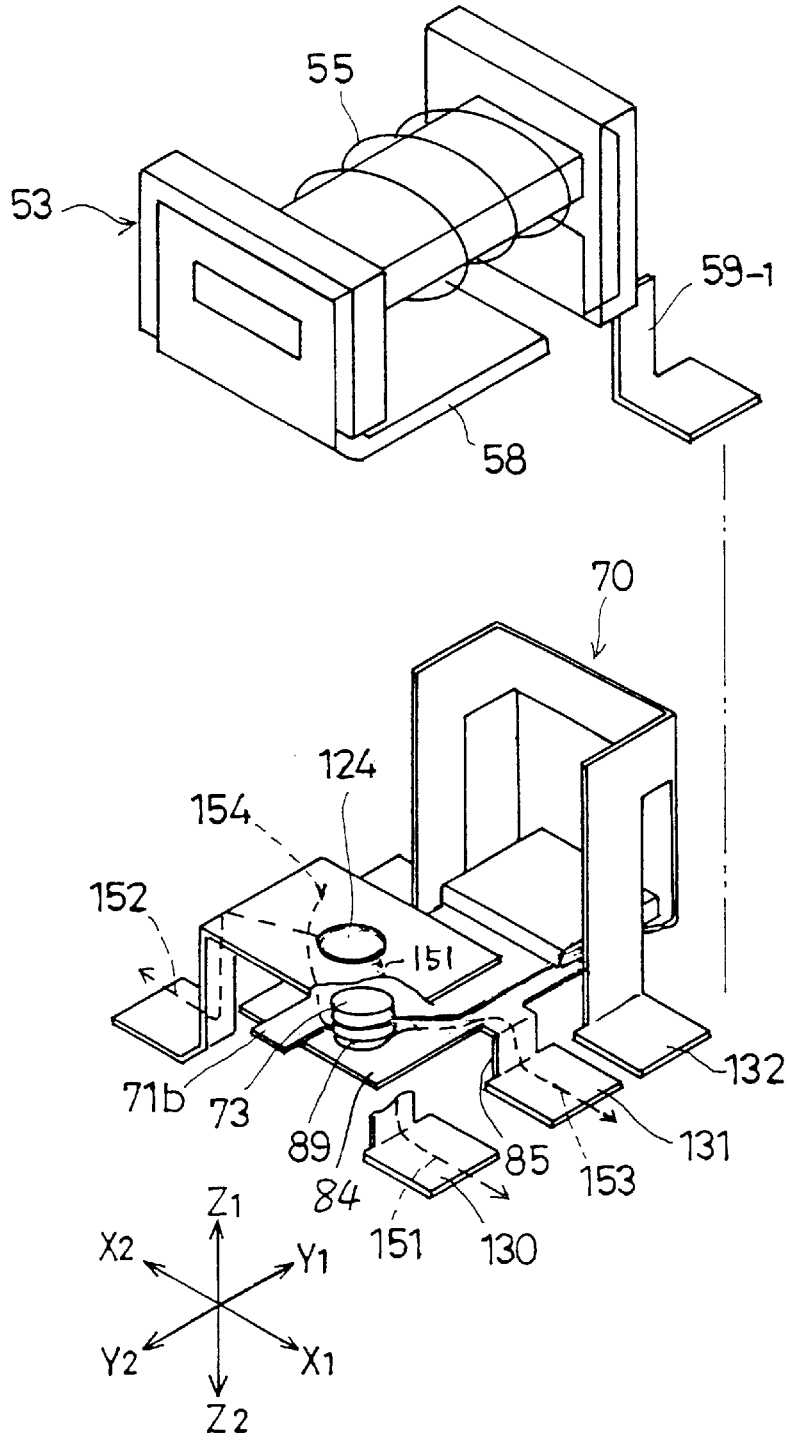
FIG. 9 is a perspective view of the interior of the electromagnetic relay from which a base mold is removed.

FIG. 9 is a perspective view of the interior of the electromagnetic relay 50 from which a base mold 100 is removed.

Next, an assembly constituting the electromagnetic relay 50 is explained. First, a description will be given of the subassembly 52.

Figure 10:
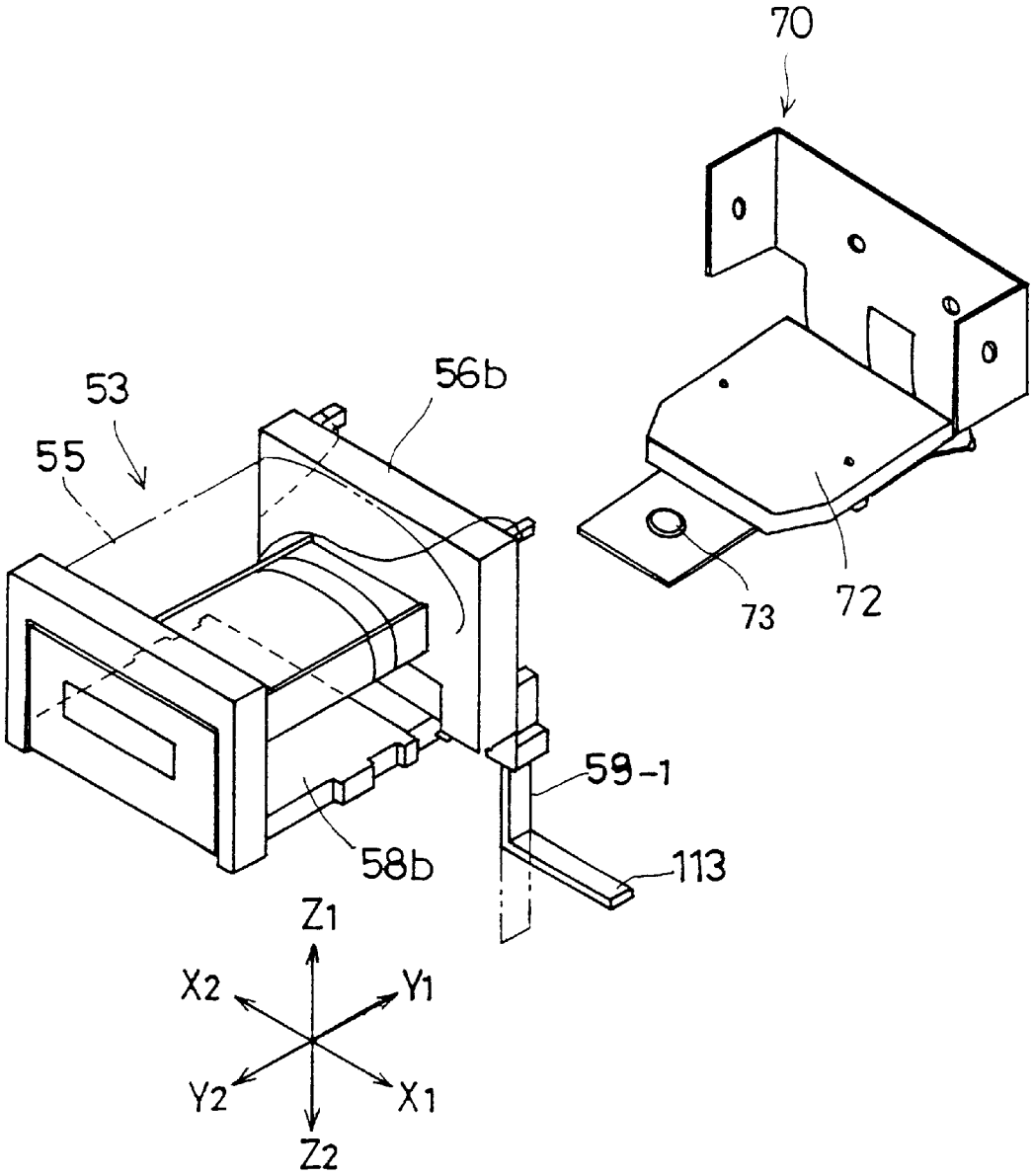
FIG. 10 is an exploded perspective view of a subassembly.
Figure 11:
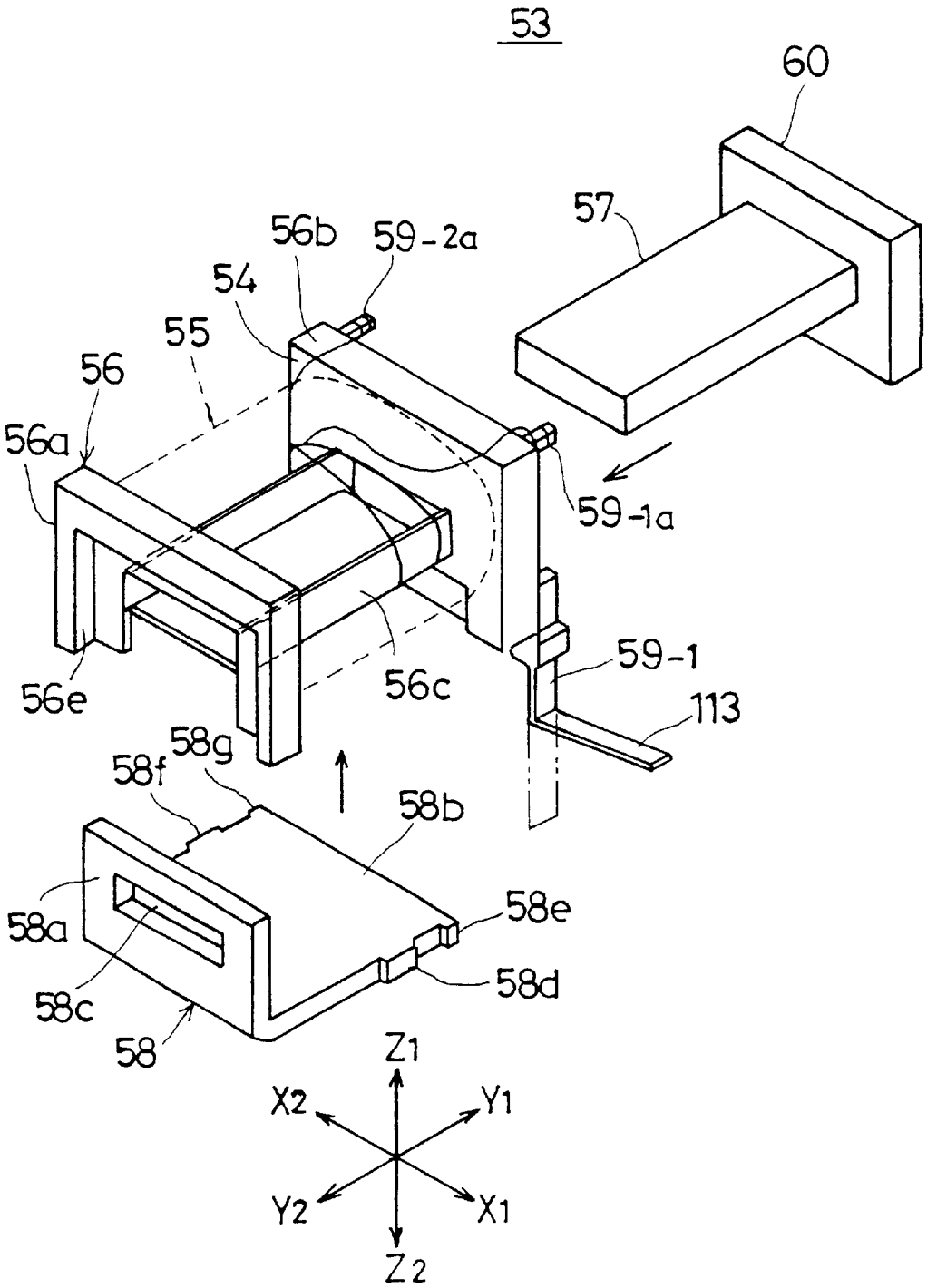
FIG. 11 is an exploded perspective view of an electromagnet assembly.

The subassembly 52 comprises an electromagnet assembly 53 and a movable leaf spring armature assembly 70, as shown in FIG. 10. The movable leaf spring armature assembly 70 is attached to the electromagnet assembly 53 on Y1 side. As shown in FIG. 11, the electromagnet assembly 53 is formed by incorporating an iron core 57 and a yoke 58 into a bobbin 56 made from a liquid crystal polymer having a coil 55 formed by a wound electric wire 54.

The bobbin 56 comprises a flange part 56*a* of a reverse U-shape on Y2 side, a flange part 56*b* of a reverse U-shape on Y1 side and a channel part 56*c* having a U-shaped cross section and connecting the flange part 56*a* and the flange part 56*b* to each other. The coil terminals 59-1 and 59-2 are insertion-molded in the flange part 56*b*. Opposite ends of the electric wire 54 are wound around bend parts 59-1*a* and 59-2*a* of upper bent portions of the coil terminals 59-1 and 59-2, respectively.

The iron core 57 with an iron board 60 is incorporated into the bobbin 56 from Y1 side in the longitudinal direction of the bobbin 56. The iron core 57 passes through the inside of the channel part 56*c,* and an end of the iron core 57 projects from the flange part 56*a*. The iron board 60 is accommodated in a concave part of the flange part 56*b*. The L-shaped yoke 58 is incorporated into the bobbin 56 from Y2 side in the longitudinal direction of the bobbin 56. A perpendicular part 58*a* of the yoke 58 is accommodated in a concave part of the flange part 56*a*. An opening 58*c* fits on an end of the iron core, and the yoke 58 is fixed by caulking. A horizontal part 58*b* of the yoke 58 horizontally extends under the coil 55. Two pairs of convex parts 58*d,* 58*e,* 58*f* and 58*g* are formed on both X1 side and X2 sides of the horizontal part 58*b* of the yoke 58, respectively.

Figure 12:
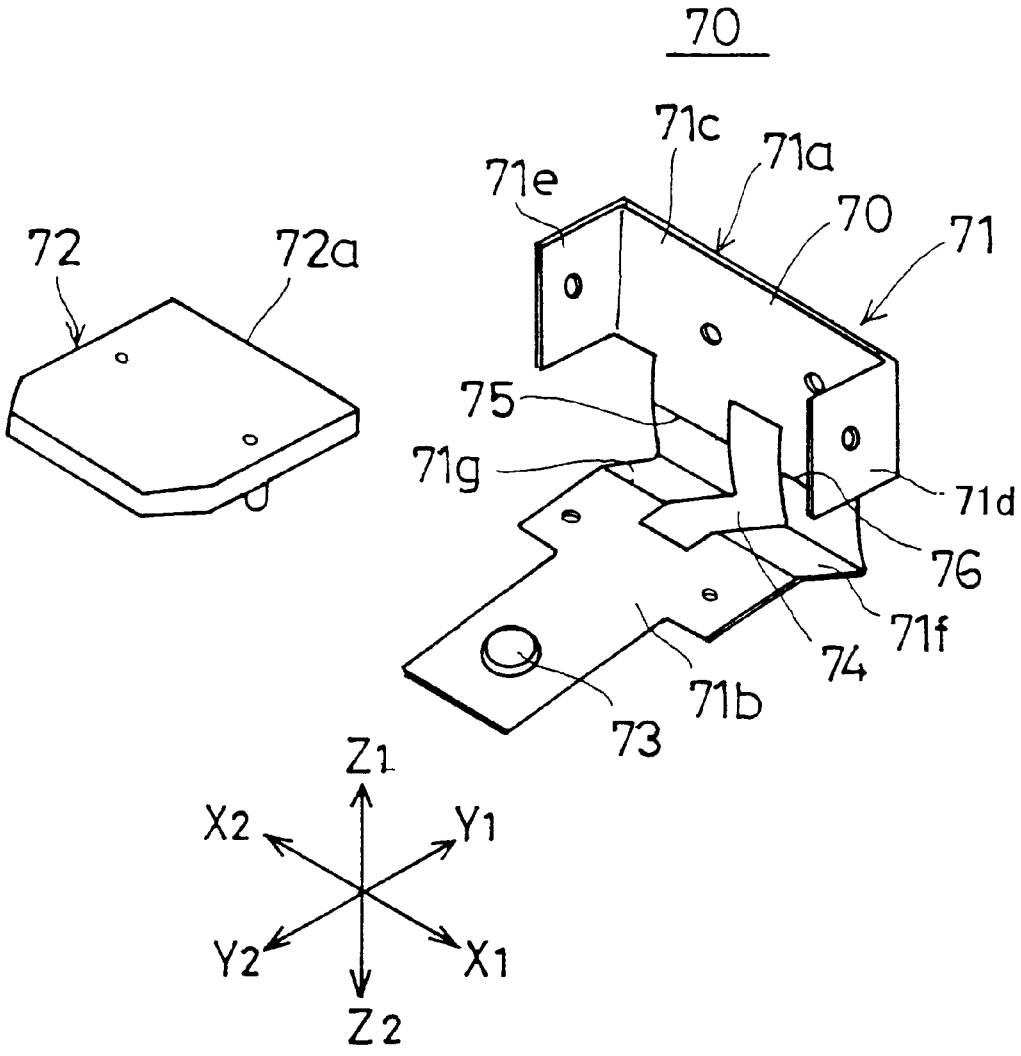
FIG. 12 is an exploded perspective view of a movable leaf spring armature assembly.

The movable leaf spring armature assembly 70 comprises, as shown in FIG. 12, a movable leaf spring 71 having a substantially L-shape, an armature 72 having a substantially square board shape and a movable contact point 73. The movable leaf spring 71 comprises a main part 71*a* and a spring arm part 71*b* extending in the Y2 direction from the main part 71*a*. The main part 71*a* has a U-shape when viewed from Z1 side, and has a central part 71*c* and arm parts 71*d* and 71*e* on both sides of the central part 71*c*. The spring arm 71*b* and the main part 71*a* are connected to each other by two connection arm parts 71*f* and 71*g*. A slit 74 exists between two connection arm parts 71*f* and 71*g*.

The spring arm part 71*b* is fixed to the armature 72 by caulking. Therefore, the armature 72 is fixed to the upper surface of the portion by the side of the root of spring arm part 71*b,* and bridges over a space part 74. When the armature 72 is magnetically attracted in the direction Z1, an upper edge part 72*a* of the armature 72 is brought into contact with parts 75 and 76, which serve as fulcrum of rotation of the spring arm part 71*b*.

A movable contact point member 73 is fixed to the tip portion of the spring arm part 71*b* by caulking. The main part 71*a* of the movable leaf spring armature assembly 70 is located on Y1 side of the electromagnet assembly 53, and the arm part 71*b* and the armature are located under the horizontal part 58*b* of the yoke 58. Main part 71*a* is fit on the flange part 56*b* so as to enclose the flange part 56*b,* and the central part 71*c* is fixed to a concave part of the iron board 60 by the caulking.

A description will now be given of the base unit 80.

The base unit 80 shown in FIG. 8 is an insertion-molded part. The base unit 80 comprises a metal plate press member 81, which is formed by pressing a metal plate, and a base mold 100 made of a liquid crystal polymer. The base mold 100 covers the metal plate press member 81.

Figure 13:
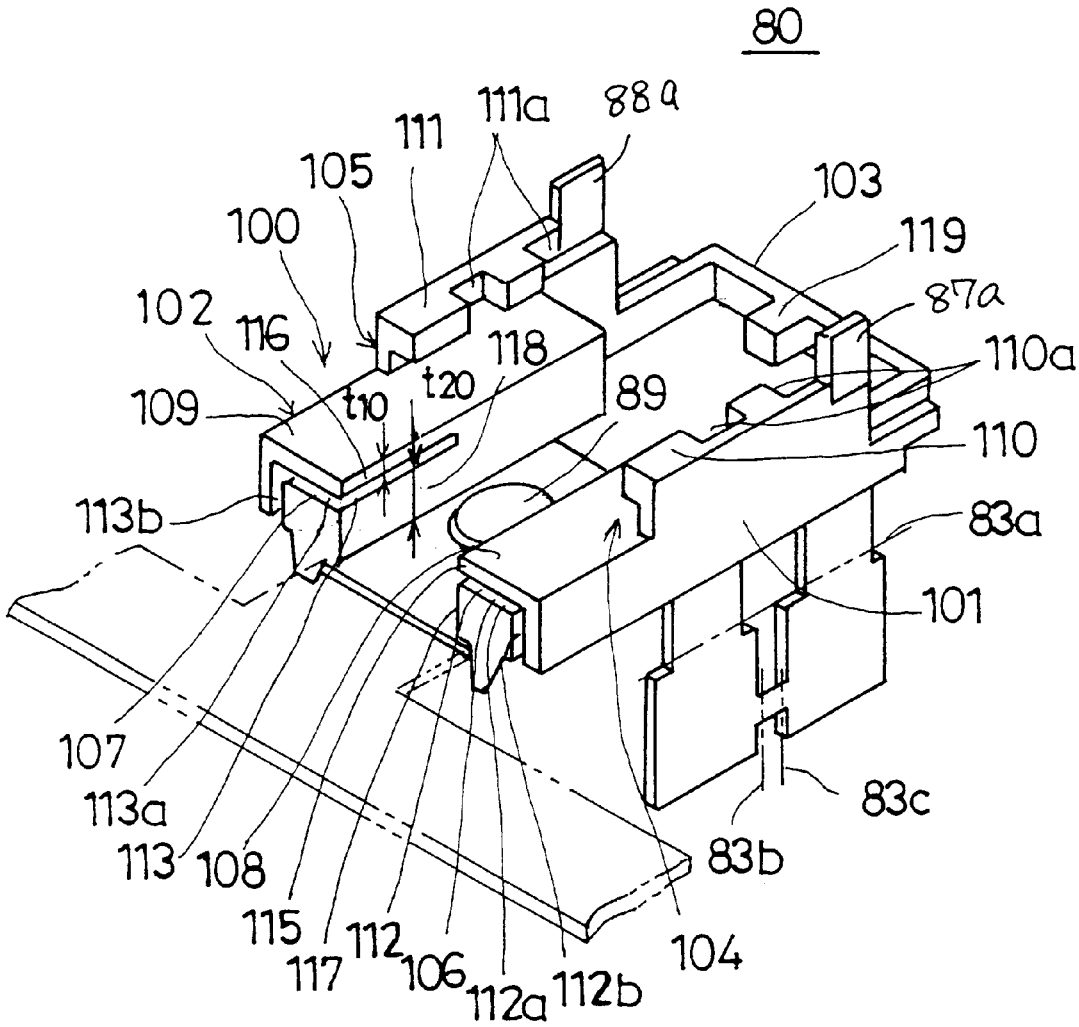
FIG. 13 is a perspective view of a base unit.
Figure 14A:
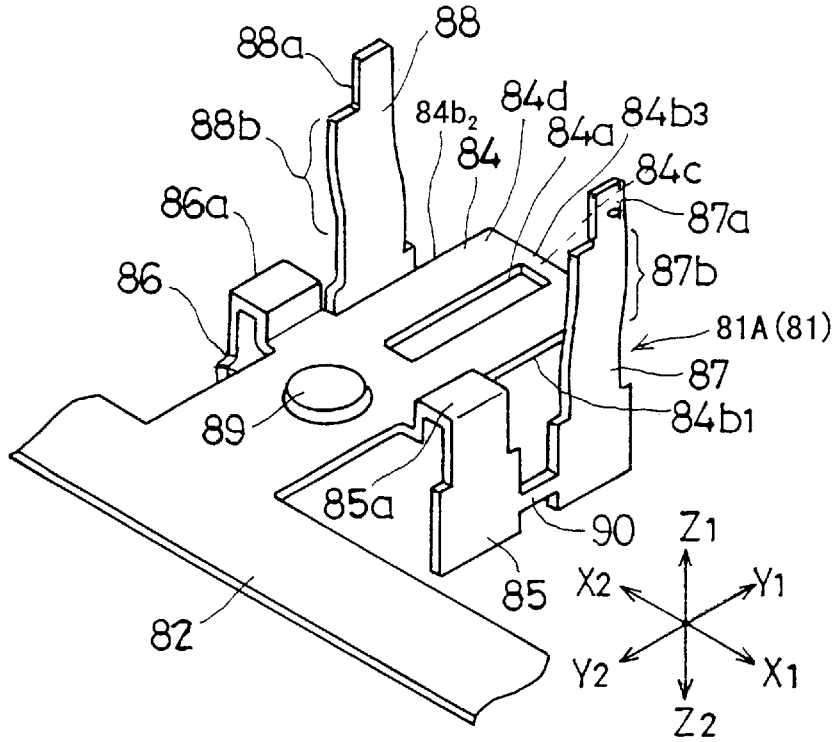
FIGS. 14A and 14B are perspective views for explaining a manufacturing process of the base unit shown in FIG. 13.
Figure 14B:
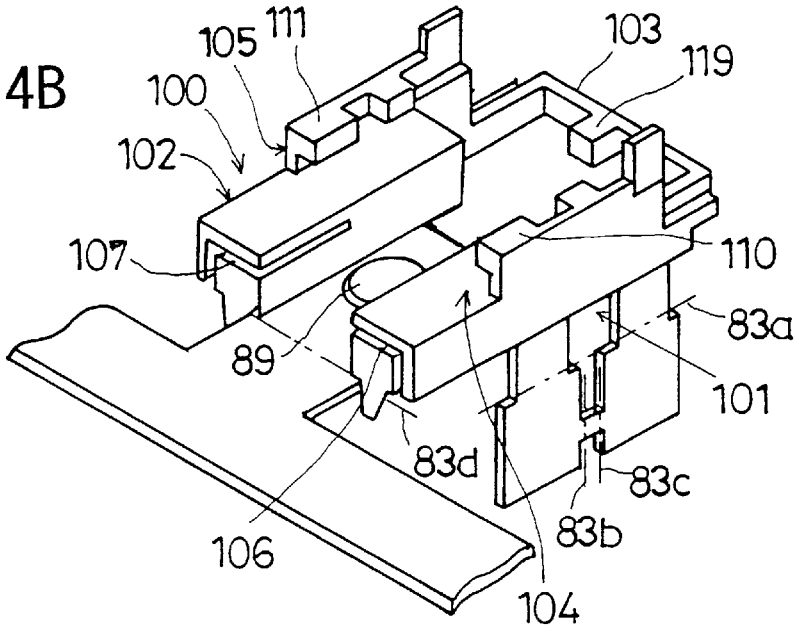

FIG. 13 is a perspective view of the base unit 80. The base unit 80 is formed by pressing a belt-like metal plate material. First, as shown in FIG. 14A, the metal plate press member 81A connected to a belt part 82 is placed in a molding die. Then, as shown in FIG. 14B, the metal plate press member 81A is insertion-molded, and, thereafter, bending is performed along a chain line 83*a*. The bending is also performed on the opposite side. Then, the belt part 83 is cut out along a chain line 83*d,* and also a connecting part 90 connecting a break terminal 85 (86) and a common terminal 87 (88) is cut out along chain lines 83*b* and 83*c*.

The metal plate press member 81 has a base plate part 84, the brake terminals 85 and 86 and the common terminals 87 and 88. The base plate part 84 has a rectangular shape, and has substantially the same size as a plan view size of the electromagnetic relay 50. A break fixed contact point member 89 is fixed to the base plate part in the vicinity of the end of Y2 side by caulking. An elongated slit 84*a* is formed in the base plate part 84 between the break fixed contact point member 89 and an end of Y1 side along the direction Y1-Y2. The periphery of the base plate part 84 includes long sides 84*b*1 and 84*b*2 along the direction Y1-Y2 and a short side 84*b*3 along the direction X1-X2.

The break terminals 85 and 86 extend from positions on the long sides 84*b*1 and 84*b*2 near the break fixed contact point member 89 in the directions X1 and X2, respectively, and then extend to the direction Z2. The break terminals 85 and 86 have connecting parts 85*a* and 86*a* having a reverse U-shape, which connect to the base plate part 84. The connecting parts 85*a* and 86*a* project from an upper surface of the base plate part 84.

The common terminals 87 and 88 are connected to the break terminals 85 and 86 by the connecting parts 90, respectively. The common terminals 87 and 88 are located on Y1 side with respect to the break terminals 85 and 86, and are located adjacent to the break terminals 85 and 86, respectively. The common terminals 87 and 88 extend in the direction Z1-Z2. The common terminals 87 and 88 have connecting parts 87*a* and 88*a* at the upper end thereof, respectively, which are connected to the movable leaf spring armature assembly 70 at the upper end. Parts 87*b* and 88*b* are formed under the connecting parts 87*a* and 88*a,* respectively.

The base mold 100 made from a liquid crystal polymer has a U-shape hen viewed from above. The base mold 100 covers both the lower surface 84*c* and the upper surface 84*d* of the base plate part 84, and fills the slit 84*a*. The base mold 100 has portions extending along the periphery of base plate part 84. That is, the base mold 100 has long side base mold parts 101 and 102 extending along the long sides 84*b*1 and 84*b*2 of the base plate part 84, respectively, and also has a short side base mold part 103 extending along the short side 84*b*3 of the base plate part 84. The base mold 100 is reinforced by the base plate part 84. The long side base mold parts 101 and 102 are reinforced by the connecting parts 85*a* and 86*a* having a reverse U-shape. Insulation resistance of the liquid crystal polymer is $10^{16}$ Ω/cm, which is higher than the insulation resistance $10^{13}$ Ω/cm of air.

The long side base mold part 101 encloses the connecting part 85*a* of the break terminal 85 and the part 87*b* of the common terminal 87. After the connecting part 90 is removed and the common terminal 87 is separated from the break terminal 85, the common terminal 87 is maintained at the original position by the long side base mold part 101. The long side base mold part 102 encloses the connecting part 86*a* of the break terminal 86 and the part 88*b* of the common terminal 88. After the connecting part is removed and the common terminal 88 is separated from the break terminal 86, the common terminal 88 is maintained at the original position by the long side base mold part 102.

The break fixed contact point member 89 is located between the long side base mold parts 101 and 102. As shown in FIG. 14B, the long side base mold parts 101 and 102 have yoke attachment parts 104 and 105 for attaching the yoke 58 of the electromagnet assembly 53 and make fixed contact point terminal member attaching parts 106 and 107 for attaching a make fixed contact point terminal member 120.

The yoke attaching parts 104 and 105 have the same rail structure, which extends in the direction Y1-Y2. The yoke attaching parts 104 and 105 comprises X-Y surfaces 108 and 109 and pressing parts 110 and 111 having a reverse U-shape, which project from the surfaces 108 and 109, respectively. Notch parts 110*a* and 111*a* are formed in the pressing parts 110 and 111, respectively, in response to the convex parts 58*d*, 58*e*, 58*f* and 58*g* of the yoke 58.

The make fixed contact point terminal member attaching parts 106 and 107 contain slits 112 and 113 formed in the long side base mold parts 101 and 102, respectively. The slits 112 and 113 have a reverse L-shape when viewed from Y2 side. The slits 112 and 113 comprise horizontal slit parts 112*a* and 113*a* located in the same X-Y plane and vertical slit parts 112*b* and 113*b*, respectively. First spacer parts 115 and 116 are located between surfaces 108 and 109 and the slits 112 and 113, respectively. The first spacer parts 115 and 116 extend toward the center from both X1 and X2 sides, and have a thickness t10. Second spacer parts 117 and 118 are located between the slits 112 and 113 and the base plate part 84, respectively. The second spacer parts 117 and 118 extend toward the center from both X1 and X2 sides, and have a thickness t20.

The short side base mold part 103 has an armature offset preventing part 119, which prevents the armature 72 from being offset.

Next, a description will be given of the make fixed contact point terminal member 120. As shown in FIG. 8, the make fixed contact point terminal member 120 comprises a square plate part 121, make terminals 122 and 123 extending in the direction Z2 from X1 and X2 sides on Y2 side of the plate part 121 and a make fixed contact point member 124 fixed to the plate part 121 by caulking.

A description will now be given of the assembling operation of the subassembly 52 to the base unit 80.

As shown in FIG. 8, a subassembly 52 is located above the base unit 80. The subassembly 52 is first moved in the direction Z2 in a state in which the convex parts 58*d*, 58*e*, 58*f* and 58*g* of the yoke 58 are aligned with corresponding notch parts 110*a* and 111*a*. Then, the subassembly 52 is attached to the base unit 80 by sliding the subassembly 52 in the direction Y2 to the end position where the convex part 56*g* enters a concave part 110*b* and abuts against a bottom surface of the concave part 110*b*. The convex parts 58*d*, 58*e*, 58*f* and 58*g* pass through the notch parts 110*a* and 111*a*, and are fit and engage with the pressing parts 110 and 111. Therefore, as shown in FIGS. 6A and 6B, the horizontal part 58*b* of the yoke 58 is supported on the surfaces 108 and 109 while being bridged between the long side base parts 101 and 102. The opposite sides of the horizontal part 58*b* of the yoke 58 in the direction X1-X2 are mounted to the yoke attaching parts 104 and 105, respectively. The subassembly 52 is assembled in a state in which the yoke 58 and the flange part 56*b* are attached to the base unit 80.

The spring arm part 71*b* is located on the side of the upper surface of the base plate 84. In addition, the position of the subassembly 52 with respect to the base unit 80 in the direction Y1-Y2 is accurately fixed by the convex part 110*b* abutting against the bottom surface of the concave part 110*b*. Moreover, the position of the subassembly 52 with respect to the base unit 80 in the direction X1-X2 is accurately fixed by the pressing parts 110 and 111. Therefore, as shown in FIGS. 6A and 6B, the movable contact point member 73 abuts against the break fixed contact point member 89 in a state in which the center thereof aligns with the center of the break fixed contact point member 89. It should be noted that the both sides of the yoke 58 in the direction X1-X2 are fixed, and, thus, the yoke 58 is firmly attached to the base unit 80 with good positioning accuracy.

A description will now be given of an assembling operation of the make fixed contact terminal member 120 to the base unit 80.

As shown in FIG. 8, the make fixed contact point terminal member 120 is located on Y2 side with respect to the base unit 80. The make fixed contact point terminal member 120 is assembled to the attaching parts 106 and 107 by being moved in the direction Y1 with respect to the base unit 80 and being inserted into the slits 112 and 113 to the end position.

The square plate part 121 is inserted into horizontal slit parts 112*a* and 113*a*, and is bridging between the long side base parts 101 and 102. The make terminals 122 and 123 are inserted into vertical slit parts 112*b* and 113*b*, respectively. Accordingly, the position of the make fixed contact point terminal member 120 in the direction X1-X2 is fixed, and also the positions of the make terminals 122 and 123 are fixed.

The make fixed contact point member 124 is located above the movable contact point member 73. Here, the side on which the make fixed contact point terminal member 120 is assembled to the base unit 80 is Y2 side. Accordingly, it is possible to assemble the terminal member 120 to the base unit 80 in a state in which the terminal member 120 bridges between the long side base parts 101 and 102, that is, the opposite sides of the terminal member 20 in the direction X1-X2 are fixed.

Since Y2 side of the base unit 80 is open, the terminal member 120 is assembled to the base unit 80 on Y2 side. That is, the portion of the subassembly 52 attached to the base unit 80 is the yoke 53 of the electromagnet assembly 53.

A description will now be given, with reference to FIGS. 6A and 6B, of positional relationships in the direction Z1-Z2.

(1) A positional relationship between the horizontal part 58*b* of the yoke 58 of the subassembly 52 and the square plate part 121 of the make fixed contact point terminal member 120:

The positional relationship between the horizontal part 58*b* and the plate part 121 is determined by the first spacer parts 115 and 116. The horizontal part 58*b* and the plate part 121 are separated from each other by a distance a10, which is equal to the thickness t10 of the first spacer parts 115 and 116.

(2) A positional relationship between the square plate part 121 of the make fixed contact point terminal member 120 and the base plate part 84 having the break fixed contact point member 89:

The positional relationship between the plate part 121 and the base plate part 84 is determined by the second spacer parts 117 and 118. The plate part 121 and the base plate part 84 are separated from each other by a distance b20, which is equal to the thickness t20 of the second spacer parts 117 and 118.

As mentioned above, the position of the horizontal part 58*b* of the yoke 58 of the subassembly 52 in the direction Z1-Z2, the position of the square plate part 121 of the make fixed contact point terminal member 120 in the direction Z1-Z2 and the position of the base plate part 84 having the break fixed contact point member 89 are accurately determined by the base mold 100 made of a liquid crystal polymer. Therefore, the variation in the size of attachment is very much smaller than that of a conventional one.

In consideration of the variation in the size of attachment, the above-mentioned distance a10 and b20 are determined with a margin. In the present embodiment, since the variation in the size of attachment is much smaller than that of the conventional electromagnetic relay, the above-mentioned distances a10 and b20 are smaller than the corresponding distances a and b of the conventional electromagnetic relay 10 shown in FIG. 1 by about 1 mm, respectively.

Figure 1:
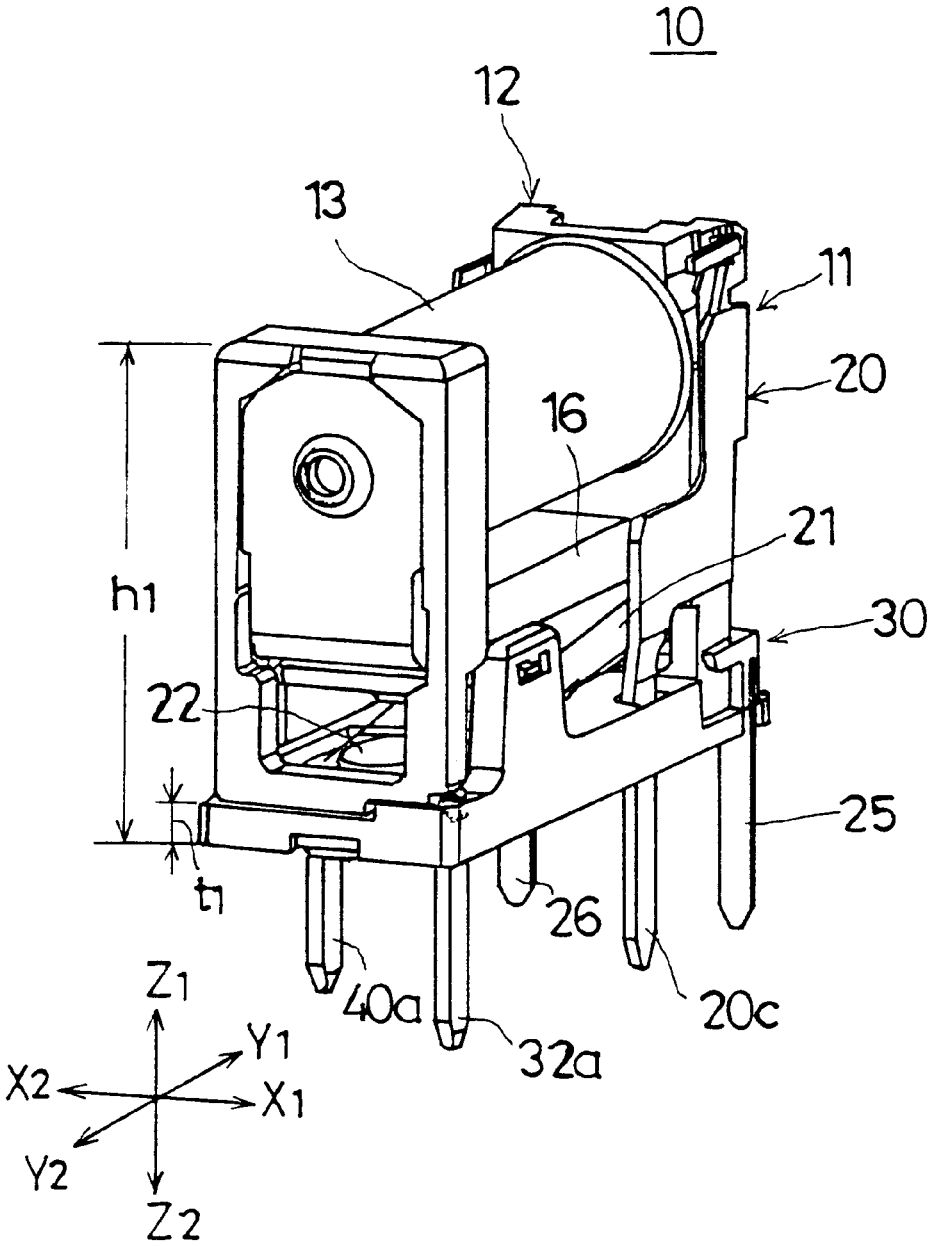
FIG. 1 PRIOR ART
FIG. 1 is a perspective view of a conventional electromagnetic relay of electric equipment for automobile in a state where a cover is removed.
Figure 2:
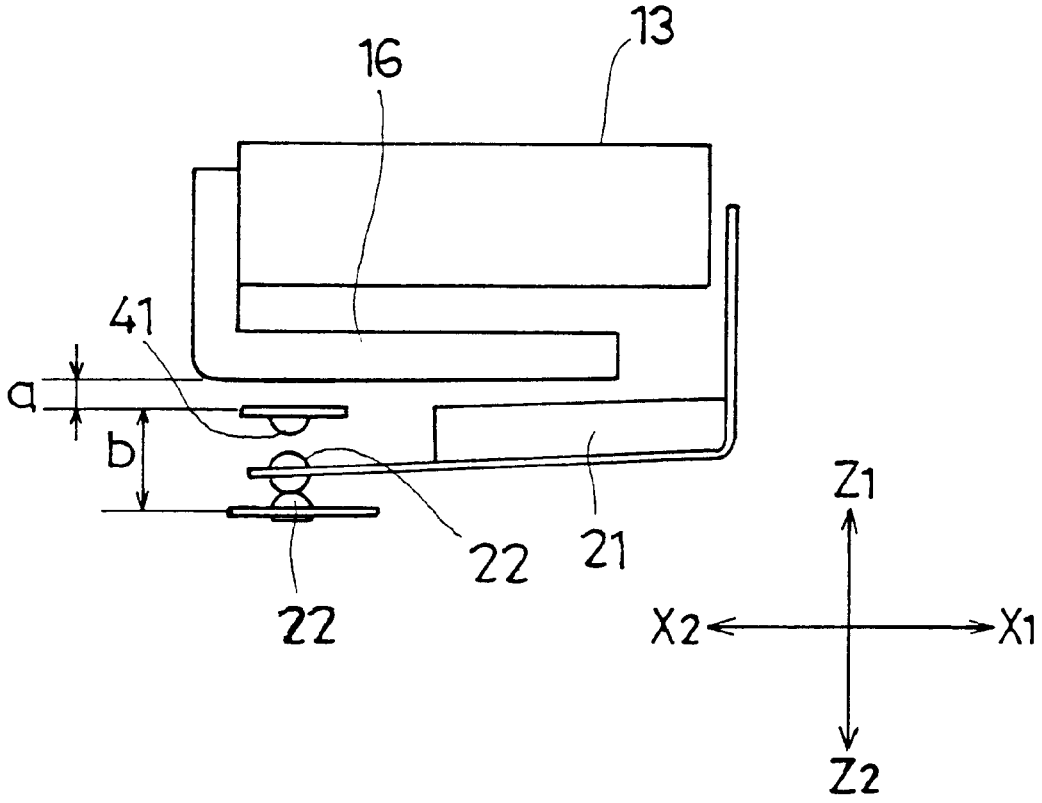
FIG. 2 PRIOR ART
FIG. 2 is a side view of the electromagnetic relay shown in FIG. 1.
Figure 3:
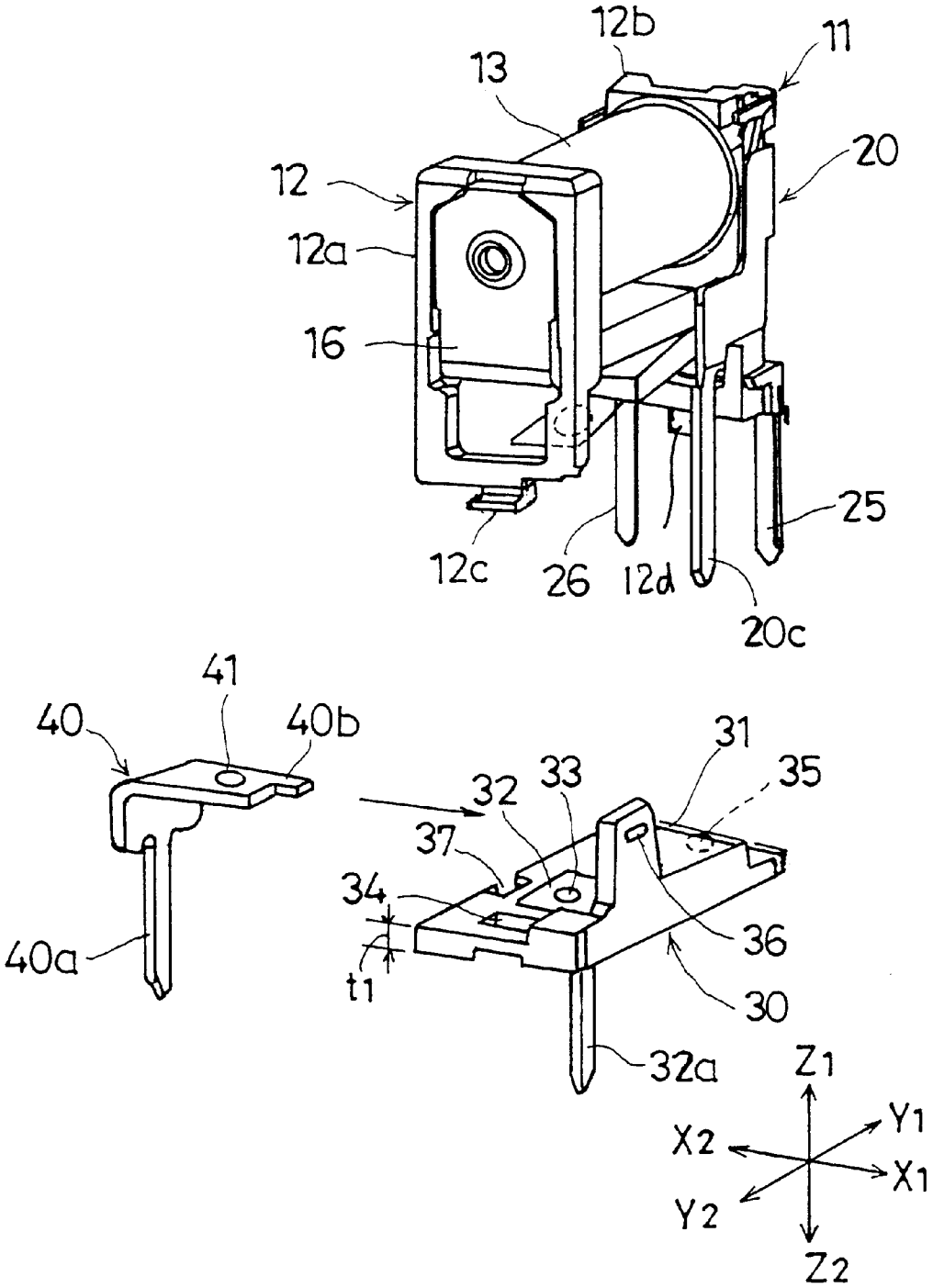
FIG. 3 PRIOR ART
FIG. 3 is an exploded perspective view of the electromagnetic relay shown in FIG. 1.
Figure 4:
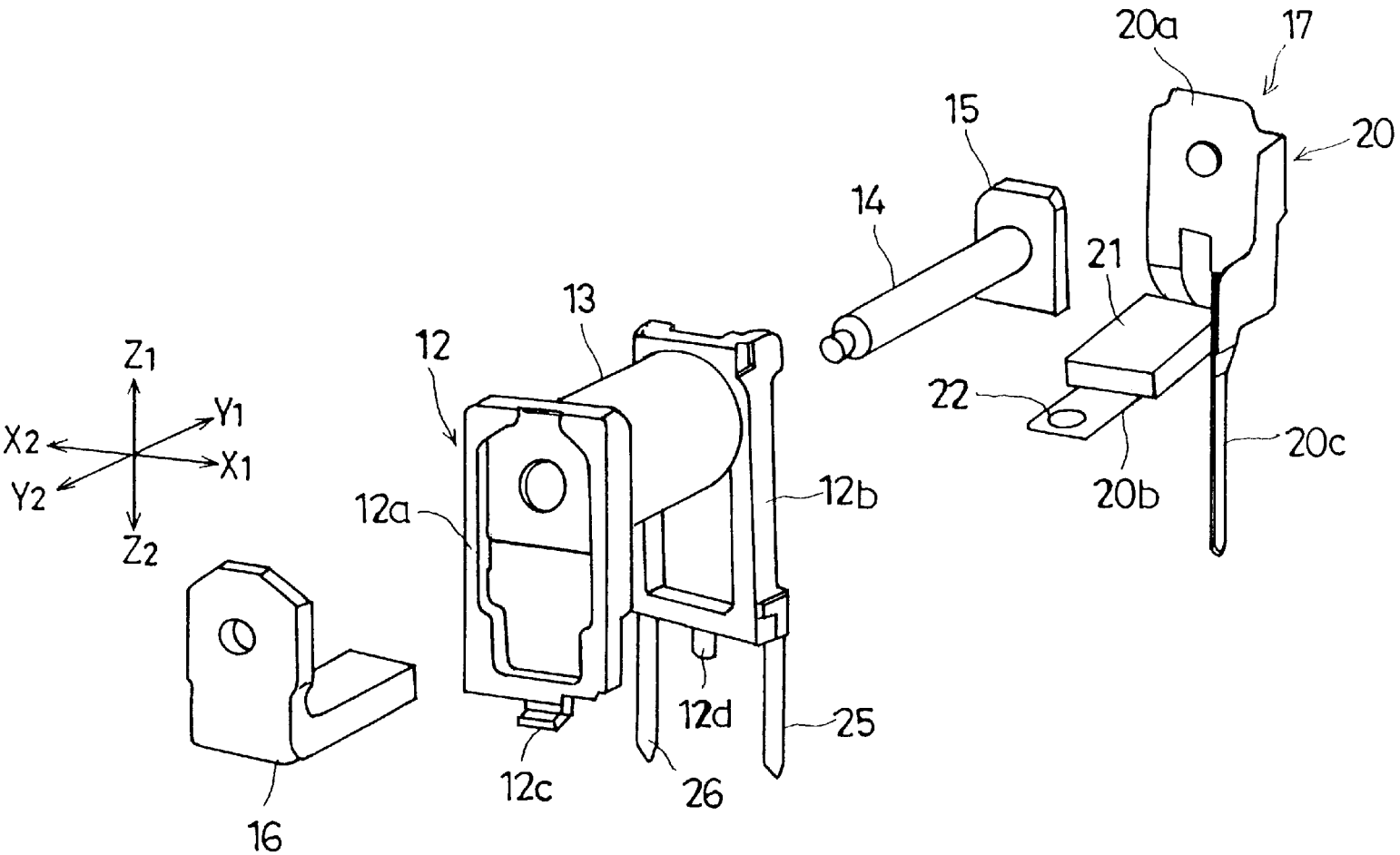
FIG. 4 PRIOR ART
FIG. 4 is a perspective view of a subassembly shown in FIG. 3.

Therefore, as shown in FIG. 5, the height of the electromagnetic relay 50 is h10, which is smaller than the height h1 of the conventional electromagnetic relay 10 of FIG. 1 by about 2 mm. Moreover, the movable contact point member 73 abuts against the break fixed contact point member 89. The common terminal tip parts 132 and 137 and the break terminal tip parts 131 and 136 are in the state of "closed", and the common terminal tip parts 132 and 137 and the make terminal tip parts 130 and 135 are in the state of "open".

Figure 15:
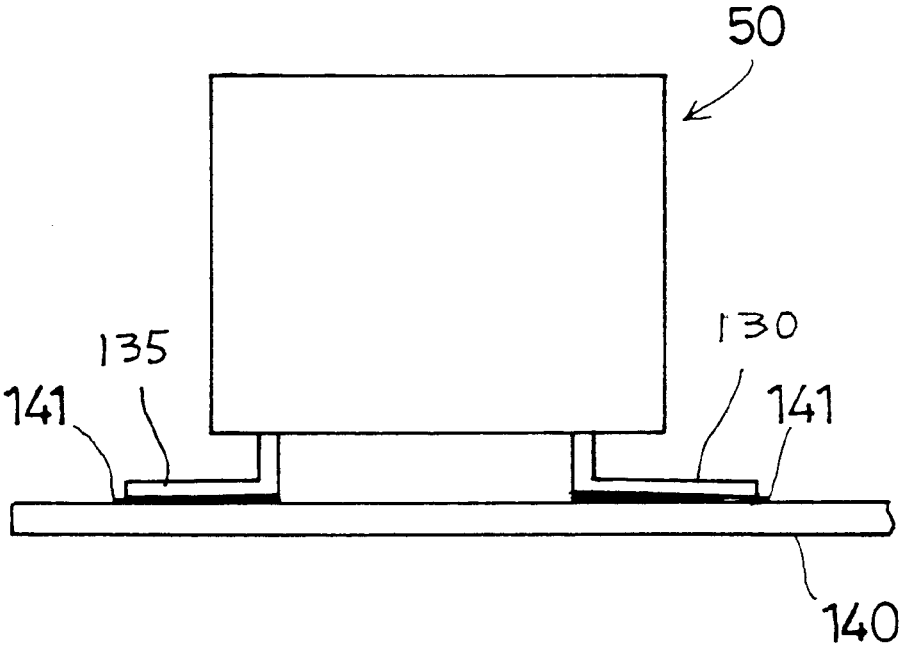
FIG. 15 is a side view of the electromagnetic relay being mounted onto a printed circuit board.

The electromagnetic relay 50 having the above-mentioned structure is surface-mounted to a printed circuit board 140, as shown in FIG. 15, by soldering the make terminal tip parts 130 and 135, the break terminal tip parts 131 and 136, the common terminal tip parts 132 and 137 and the coil terminal tip parts 133 and 138 to pads 141 on the printed circuit board 140. Then, the printed circuit board 140 is attached to an automobile.

When a current is supplied to the coil 55, the coil 55 is excited and the yoke 58 is magnetically attracted by the armature 72. Accordingly, the spring arm part 71*b* rotates upward about the fulcrums 75 and 76, which results in the movable contact points member 73 separated from the break fixed contact point member 89 and contacting the make fixed contact point member 124. Therefore, the common terminal tip parts 132 and 137 and the break terminal tip parts 131 and 136 are changed to the state of "open", and the common terminal tip parts 132 and 137 and the make terminal tip parts 130 and 135 are changed to the state of "closed" When the current flowing in the coil 55 is cut off, the electromagnetic relay 50 returns to the original normal state.

A description will now be given of a heat radiation of the electromagnetic relay 50 in use.

When the coil 55 is excited and the movable contact point member contacts the make fixed contact point member 124 and the common terminal tip parts 132 and 137 and the makeup terminal tip parts 130 and 135 are changed to the state of "closed", and if an electric current of 30 A flows in the coil 55, a large amount of heat is generated especially between the common terminal tip parts 132 and 137 and the makeup terminal tip parts 130 and 135, which are brought into contact with each other. The generated heat is transmitted to the printed circuit board 140 via two routes, first and second transmission routed, as shown in FIG. 9.

The first transmission route 151 extends in the direction X1 from the make fixed contact point member 124, and includes the movable contact point member 73→the make fixed contact point member 124→the plate part 121→the make terminal 122→the make terminal tip part 130→the printed circuit board 140. The second transmission route 152 extends in the direction X, which is opposite to the direction X1, from the make fixed contact member 124, and includes the movable contact point member 73→the make fixed contact point member 124→the plate part 121→the make terminal 123→the make terminal tip part 135→the printed circuit board 140.

Thus, as shown in FIG. 9, the heat generated inside the electromagnetic relay 50 transmits the two transmission routes 151 and 152, which are extending in opposite directions, to reach the printed circuit board, and is efficiently radiated from the printed circuit bard 140.

It should be noted that the number of make terminals can be three or four. In such a case, the number of the transmission routes for heat radiation is three or four, and the heat generated inside the electromagnetic relay can be radiated more efficiently.

Also the number of the break terminals and common terminals can be three or four. Here, the width w1 of the make terminal tip parts 130 and 135 in the direction Y1-Y2 is larger than the width w2 of the make terminals 122 and 123. Therefore, a contact surface area between the make terminal tip parts 130 and 135 and the printed circuit board 140 is large, and, thus, the heat resistance between the make terminal tip parts 130 and 135 and the printed circuit board 140 is small. Therefore, transfer of heat from the make terminal tip parts 130 and 135 to the printed circuit board 140 is performed smoothly. This also allows the efficient transfer of heat generated inside the electromagnetic relay 50 to the printed circuit board 140.

It should be noted that, depending on an electric circuit incorporated into the electromagnetic relay 50, there is a case in which a current flows in the electromagnetic relay 50 in a state where the movable contact point member 73 is brought into contact with the break fixed contact point member 89. In such a case, heat generated in a portion in which the movable contact point member 73 contacts the break fixed contact point member 89 is transmitted to the printed circuit board 140 via two routes, which are transfer routes 153 and 154, and the transmitted heat is efficiently radiated from the printed circuit board 140. The transfer route 153 includes the movable contact point member 73→the break fixed contact point member 89→the base plate part 84→the break terminal 85→the break terminal tip part 131→printed circuit board 140. The transfer route 154 includes the movable contact point member 73→the break fixed contact point member 8943 the base plate part 84→the break terminal 86→the break terminal tip part 136 the printed circuit board 140.

A description will now be given of a heat stress exerted on the electromagnetic relay 50, which is surface-mounted on the printed circuit board 140.

A heat stress is generated due to a difference in a thermal expansion coefficient between the electromagnetic relay 50 and the printed circuit board 140. The generated heat stress is exerted on soldered portions between the terminal tip parts and pads 141 formed on the printed circuit board 140. When the heat stress is large, a problem may occur that the soldered portions between terminal tip parts and the pads 141 on the printed circuit board 140 break within a comparatively short time after the beginning of use.

The common terminals 87 and 88, the break terminals 85 and 86 and the make terminals 122 and 123 form pairs, respectively, and the pair of terminals are connected in parallel electrically. Therefore, if an electric current flowing through one terminal, which comprises a pair of contact points, is 30 A, a current which flows through one of the contact points is 15 A. Accordingly, a cross-sectional area of each terminal can be one half of a cross-sectional area of each terminal of a case in which the number of the common terminals, the break terminals and the make terminals is one, respectively. Therefore, each of the common terminals 87 and 88, the break terminals 85 and 86 and the make terminal 122 and 123 can be formed with a smaller bending strength (stiffness) than that of the conventional one. Thus, each terminal can bend easily, and the heat stress exerted on the soldered portions can be relaxed easily.

Moreover, as shown in FIG. 7A, the make terminal tip parts 130 and 135, the break terminal tip parts 131 and 136, the common terminal tip parts 132 and 137 and the coil terminal tip parts 133 and 138 align along the respective sides extending in the longitudinal direction of the electromagnetic relay 50. Additionally, each terminal projects from the electromagnetic relay 50 in the direction X1 or X2, and is accommodated inside a rectangle 160 indicated by double dashed dotted lines in FIG. 7A. Therefore, a distance L1 between the make terminal tip part 130 and the coil terminal tip part 138, which distance L1 is the largest distance from among distances between the terminal tip parts, is smaller than that of the conventional one. Thus, the difference in an amount of thermal deformation between the electromagnetic relay 50 and the printed circuit board 140 is smaller than the conventional electromagnetic relay, the thermal deformation of the electromagnetic relay 50 being generated between the make terminal tip part 130 and the coil terminal tip part 138

Accordingly, the heat stress which acts on the soldered portion between each terminal tip part and the corresponding pad 141 on the printed circuit board 140 is smaller than that of the conventional electromagnetic relay. Therefore, the reliability of surface mounting of the electromagnetic relay 50 onto the printed circuit board 140 is improved. In addition, since a width w1 of each terminal tip part (foot part) in the direction Y1-Y2 is larger than a width w2 of the terminal (leg), a soldering area of each terminal tip with the pad is large. This composition also improves the reliability of surface mounting of the electromagnetic relay 50 onto the printed circuit board 140.

Figure 16A:
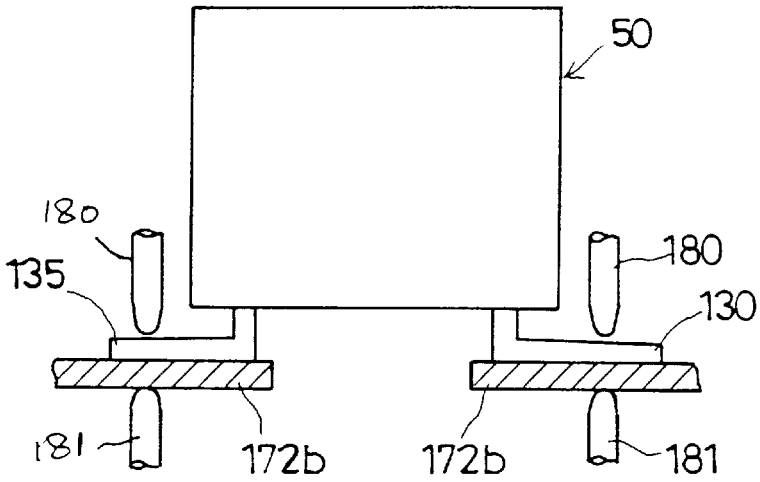
FIG. 16A is a side view of the electromagnetic relay being mounted to a relay box.
Figure 16B:
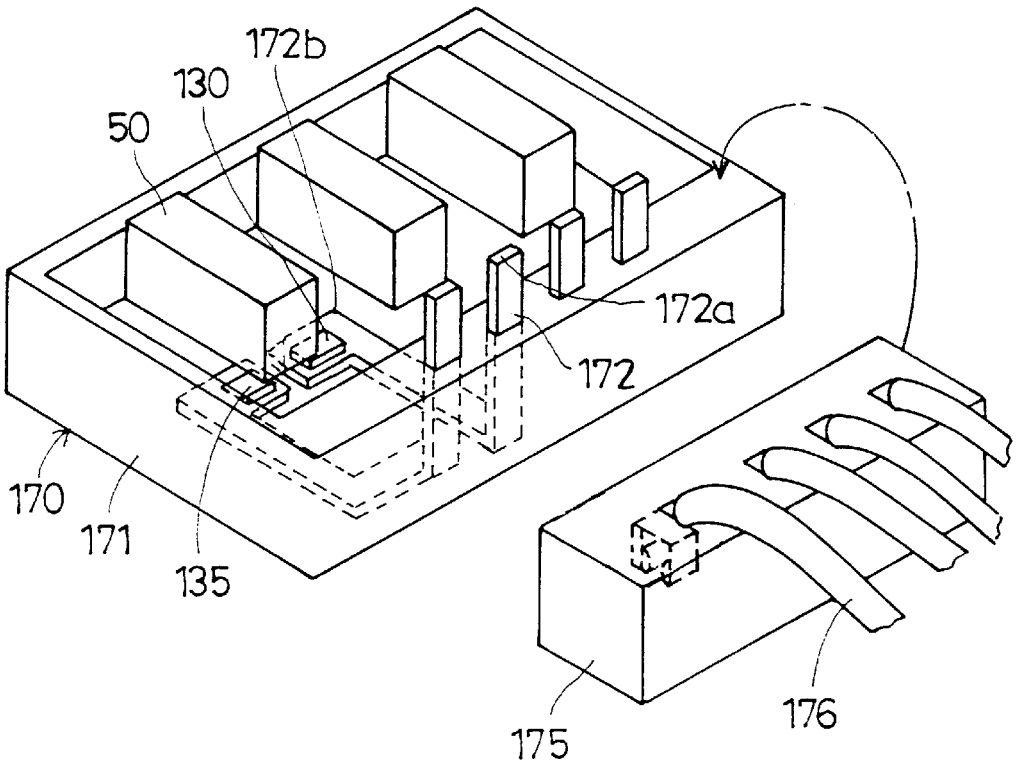
FIG. 16B is a perspective view of an interior of the relay box.

The electromagnetic relay 50 can also be incorporated into a relay box 170 of an automobile, as shown in FIGS. 16A and 16B. As shown in FIG. 16B, the relay box 170 comprises a box-like housing 171 made of a plastic, a plurality of terminal members 172 insertion-molded in the housing 171 and a plurality of the electromagnetic relays 50 provided inside the housing 171. A connector 175 attached to ends of cables 176 is connected to terminal parts 172*a* formed at ends of the terminal members. Terminal pars 172*b* at opposite ends of the terminal members 172 extend horizontally. The terminal parts 172*b* are arranged correspondingly to the arrangement of the terminal tip parts of each electromagnetic relay 50.

As shown in FIG. 16A, the terminal tip parts 130 and 135 of the electromagnetic relay 50 are spot-welded to the terminal parts 172*b* in a state where the terminal tip parts 130 and 135 are placed on the corresponding terminal parts 172*b* and sandwiched by the electrodes 180 and 181. It should be noted that the spot welding can be carried out since each of the terminal tip parts 130 and 135 has a large width. The terminal parts 172*b* of the other ends of the terminal members 172 extend horizontally, and there is no need to bend the terminal members 172 downward.

A description will now be given, with reference to FIGS. 6B and 6C, of an action of the armature offset preventing projection 119.

When the electromagnetic relay 50 falls from a high position, a strong shock may act on the electromagnetic relay 50. The spring arm 71*b* of the electromagnetic relay 50 may deforms due to the shock, and, thereby, the position of the armature 72 may shift. In such a case, the position of fulcrums 75 and 76 is shifted, which results in an undesired problem in that a condition of contract between the movable contact point member 73 and the break contact point member 89 or the make contact point member 124 is changed.

In the present embodiment, the armature offset preventing projection 119 is provided under the armature 72 within the slit 74 between the connecting parts 71*f* and 71*g*. When a strong shock is exerted on the electromagnetic relay 50 and the armature tends to greatly deform in the direction Z2, the armature offset preventing projection 119 contacts the armature 72. Accordingly, the spring arm 71*b* is prevented from being bent at a root thereof, which prevents the position of the armature 72 from shifting. Therefore, the electromagnetic relay 50 has a high shock resistance.

A description will now be given, with reference to FIG. 17, of a second embodiment of the present invention.

Figure 17:
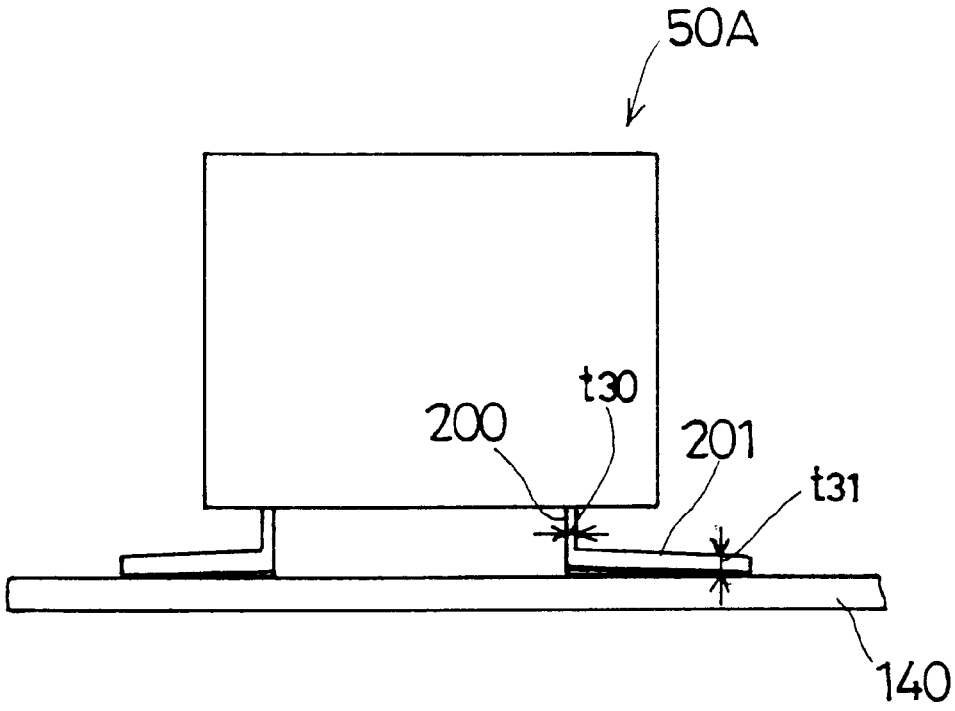
FIG. 17 is a side view of an electromagnetic relay according to a second embodiment of the present invention.

FIG. 17 is a side view of an electromagnetic relay 50A for automobile electric devise according to the second embodiment of the present invention. The electromagnetic relay 50A has basically the same structure as that of the above-mentioned electromagnetic relay 50 except for the following points.

In the present embodiment, a thickness t30 of each terminal (leg part) 200 of the electromagnetic relay 50A is smaller than a thickness t31 of each terminal tip part (foot part) 201. According to this composition, a bending strength (stiffness) of the terminal 200 is small, and, therefore, the terminal 200 can further relax the thermal stress.

A description will now be given, with reference to FIGS. 18A and 18B, of a third embodiment of the present invention.

Figure 18A:
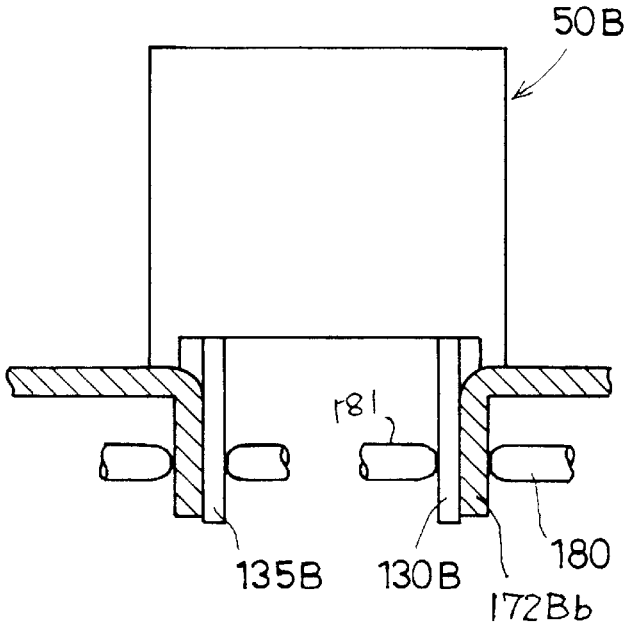
FIG. 18A is a side view of an electromagnetic relay according a third embodiment of the present invention.
Figure 18B:
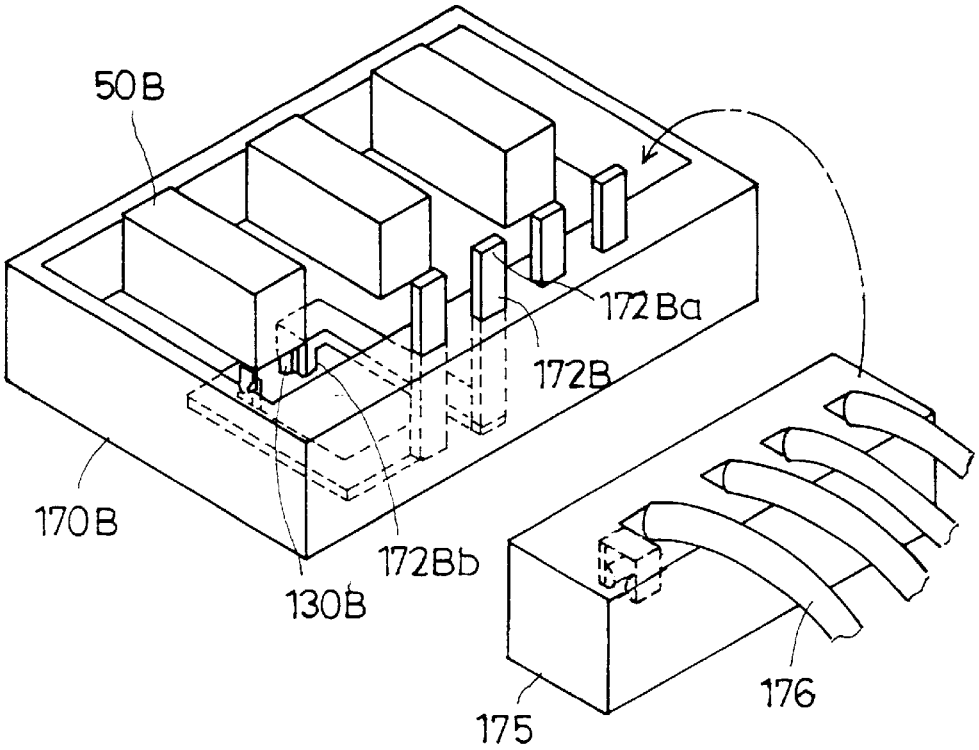
FIG. 18B is a perspective view of an interior of the electromagnetic relay shown in FIG. 18A.

FIG. 18A is a side view of an electromagnetic relay 50B for automobile electric devices according to the third embodiment of the present invention. FIG. 18B is a perspective view of an interior of the electromagnetic relay 50B shown in FIG. 18A. The electromagnetic relay 50B has basically the same structure as that of the above-mentioned electromagnetic relay 50 except for the following points.

In the present embodiment, each of terminal tip parts 130B and 135B of the electromagnetic relay 50B extends vertically. The electromagnetic relay 50B is mounted to a relay box 170B by spot welding the vertically extending terminal tip parts 130B and 135B to terminal parts 172B*b* of terminal members 172B. The connector 175 attached to ends of the cables 176 is connected to terminal parts 172B*a* formed at ends of the terminal members 172B. In this embodiment, the terminal part 172B*b* of each of the terminal members 172B is bent downward.

The present invention is not limited to specifically disclosed embodiments, and variations and modifications may be made without departing from the scope of the present invention.

The present application is based on Japanese priority application No. 2001-133057 filed on Apr. 27, 2001, the entire contents of which are hereby incorporated by reference.

What is claimed is:

1. An electromagnetic relay comprising:

a base unit including a metal plate member and a base mold made of a plastic, the metal plate member having a break fixed contact point and a break terminal and being insertion-molded with the base mold;

a subassembly fixed to an upper side of the base unit and including an electromagnet assembly and a movable leaf spring/armature assembly attached to the electromagnetic assembly, the electromagnet assembly including a bobbin, a coil, an iron core and a yoke, the movable leaf spring/armature assembly including a movable leaf spring having a movable contact point and an armature fixed to the movable leaf spring; and a make terminal member fixed to the base unit and having a make fixed contact point and a make terminal, wherein the base mold of the base unit has a yoke attaching part to which the yoke of the electromagnet assembly is attached and a make terminal member attaching part to which the make terminal member is attached, and the subassembly is mounted to the base unit by the yoke of the electromagnet assembly being attached to the yoke attaching part of the base mold, and the make terminal member is mounted to the base unit by being attached to the make terminal member attaching part of the base mold.

2. The electromagnetic relay as claimed in claim 1, wherein:

the metal plate member has a base plate part having the same horizontal projection size as that of the electromagnetic relay;

the base mold extends along a periphery of the base plate part and has long side base mold parts opposite to each other;

each of the yoke attaching part and the make terminal member attaching part is formed on each of the long side base mold parts; and both sides of each of the yoke and the make terminal member are secured to the respective long side base mold parts.

3. The electromagnetic relay as claimed in claim 1, wherein the metal plate member has a base plate part having the same horizontal projection size as that of the electromagnetic relay, and the base mold extends along a periphery of the base plate part and has an armature offset preventing projection, which faces a lower surface of the armature.

4. The electromagnetic relay as claimed in claim 1, wherein a number of each of common terminals, brake terminals and make terminals, which are electrically connected to the movable leaf spring, is plural.

5. The electromagnetic relay as claimed in claim 1, wherein a number of each of common terminals, the brake terminals and the make terminals, which are electrically connected to the movable leaf spring, is two; and one of the two terminals is located on one side of the electromagnetic relay and the other is located on the other side of the electromagnetic relay.

6. The electromagnetic relay as claimed in claim 5, wherein an end of each of the terminals is bent outward.

7. The electromagnetic relay as claimed in claim 6, wherein each of the terminals includes a leg part and a foot part, the foot part being formed by bending each terminal to as to extend horizontally; and a width of the foot part is larger than a width of the leg part.

8. The electromagnetic relay as claimed in claim 6, wherein each of the terminals includes a leg part and a foot part, the foot part being formed by bending each terminal to as to extend horizontally; and a thickness of the leg part is smaller than a thickness of the foot part.

* * * * *